US010316645B2

(12) United States Patent
Ingraham et al.

(10) Patent No.: US 10,316,645 B2
(45) Date of Patent: Jun. 11, 2019

(54) AUTONOMOUS UNTETHERED WELL OBJECT

(71) Applicant: Schlumberger Technology Corporation, Sugar Land, TX (US)

(72) Inventors: Derek Ingraham, Sugar Land, TX (US); Eugene Janssen, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 475 days.

(21) Appl. No.: 14/891,625

(22) PCT Filed: May 16, 2014

(86) PCT No.: PCT/US2014/038343

§ 371 (c)(1),
(2) Date: Nov. 16, 2015

(87) PCT Pub. No.: WO2014/186672

PCT Pub. Date: Nov. 20, 2014

(65) Prior Publication Data

US 2016/0084075 A1 Mar. 24, 2016

Related U.S. Application Data

(60) Provisional application No. 61/824,591, filed on May 17, 2013, provisional application No. 61/824,240, filed on May 16, 2013, provisional application No. 61/824,260, filed on May 16, 2013.

(51) Int. Cl.

| | |
|---|---|
| ***E21B 47/09*** | (2012.01) |
| ***E21B 23/01*** | (2006.01) |
| ***E21B 23/10*** | (2006.01) |

(52) U.S. Cl.
CPC ..... *E21B 47/09* (2013.01); *E21B 23/01* (2013.01); *E21B 23/10* (2013.01); *E21B 47/0905* (2013.01)

(58) Field of Classification Search
CPC ..... E21B 47/09; E21B 23/01; E21B 23/10; E21B 47/0905
See application file for complete search history.

(56) References Cited

U.S. PATENT DOCUMENTS

| | | | | |
|---|---|---|---|---|
| 6,234,257 | B1 * | 5/2001 | Ciglenec | E21B 7/06 166/250.01 |
| 2008/0156977 | A1 | 7/2008 | Jeffryes | |
| 2011/0056692 | A1 | 3/2011 | Lopez de Cardenas et al. | |
| 2011/0240311 | A1 | 10/2011 | Robison et al. | |
| 2011/0284240 | A1 | 11/2011 | Chen et al. | |

(Continued)

OTHER PUBLICATIONS

International Search Report and Written Opinion for corresponding PCT Application Serial No. PCT/US2014/038343, dated Sep. 25, 2014, 17 pages.

*Primary Examiner* — Wei Wang

(57) ABSTRACT

A technique includes deploying an untethered object though a passageway of a tubular member; and acquiring a plurality of measurements that represent an environment of the tubular member as the object is being communicated through the passageway. The technique includes cross-correlating the plurality of measurements and using results of the cross-correlating to identify at least one feature of the tubular member.

10 Claims, 20 Drawing Sheets

(56) References Cited

U.S. PATENT DOCUMENTS

2012/0085538 A1* 4/2012 Guerrero ..... E21B 33/12
166/284
2015/0260013 A1* 9/2015 Booker ..... E21B 34/066
166/250.01

* cited by examiner

AUTONOMOUS UNTETHERED WELL OBJECT

BACKGROUND

For purposes of preparing a well for the production of oil or gas, at least one perforating gun may be deployed into the well via a conveyance mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools. A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, a technique includes deploying an untethered object though a passageway of a string in a well; and acquiring a plurality of measurements that represent an environment of the string as the object is being communicated through the passageway. The technique includes cross-correlating the plurality of measurements and using results of the cross-correlating to identify at least one downhole feature.

In another example implementation, an apparatus that is usable with a well includes string and an untethered object that is adapted to be deployed in a passageway of the string, such that the untethered object travels in the passageway. The untethered object includes a magnetic field generator; antennae that are spatially separated to provide a plurality of signals generated in response to a magnetic field generated by the magnetic field generator; an expandable element; and a controller. The controller of the untethered object cross-correlates the signals; uses the cross-correlation of the signals to identify at least one downhole feature of the string; and selectively radially expands the element based at least in part on the at least one identified downhole feature.

In another example implementation, a technique includes deploying an untethered object though a passageway of a string in a well; sensing a property of an environment of the string as the object is being communicated through the passageway; and selectively autonomously radially expanding the untethered object in response to the sensing. Radially expanding the untethered object includes creating fluid communication between two chambers of the object at different pressures to cause translational movement of a piston of the object; and expanding a collar of the object in response to the translation of the piston.

In another example implementation, an apparatus that is usable with a well includes a string and an untethered object that is adapted to be deployed in the passageway such that the object travels in the passageway. The untethered object includes a first chamber at a relatively lower pressure; a second chamber at a relatively high pressure; a fluid control device between the first and second chambers; a piston; an expandable collar that is coupled to the piston; and a controller to operate the fluid control device to establish communication between the first and second chambers to selectively radially expand the untethered object.

In another example implementation, an apparatus that is usable with a well includes a string and an untethered object that is adapted to be deployed in a passageway of the string such that the object travels in the passageway. The untethered object includes a first chamber at a relatively lower pressure; a second chamber at a relatively high pressure; a fluid control device between the first and second chambers; a piston; an expandable collar that is coupled to the piston; and a controller to operate the fluid control device to establish communication between the first and second chambers to selectively radially expand the untethered object.

In another example implementation, a technique that is usable with a well includes deploying an untethered object though a passageway of a string in a well. The string comprising at least one dedicated location identification marker. The technique includes detecting a feature of the string as the object is being communicated through the passageway. The detecting includes actuating at least one mechanically-actuated switch of the object in response to engagement of the object with the at least one dedicated identification marker to register a count; and selectively autonomously operating the untethered object in response to the count.

In yet another example implementation, a technique includes deploying an untethered object though a passageway of a tubular member; and acquiring a plurality of measurements that represent an environment of the tubular member as the object is being communicated through the passageway. The technique includes cross-correlating the plurality of measurements and using results of the cross-correlating to identify at least one feature of the tubular member.

Advantages and other features will become apparent from the following drawings, description and claims.

DETAILED DESCRIPTION

Figure 1:
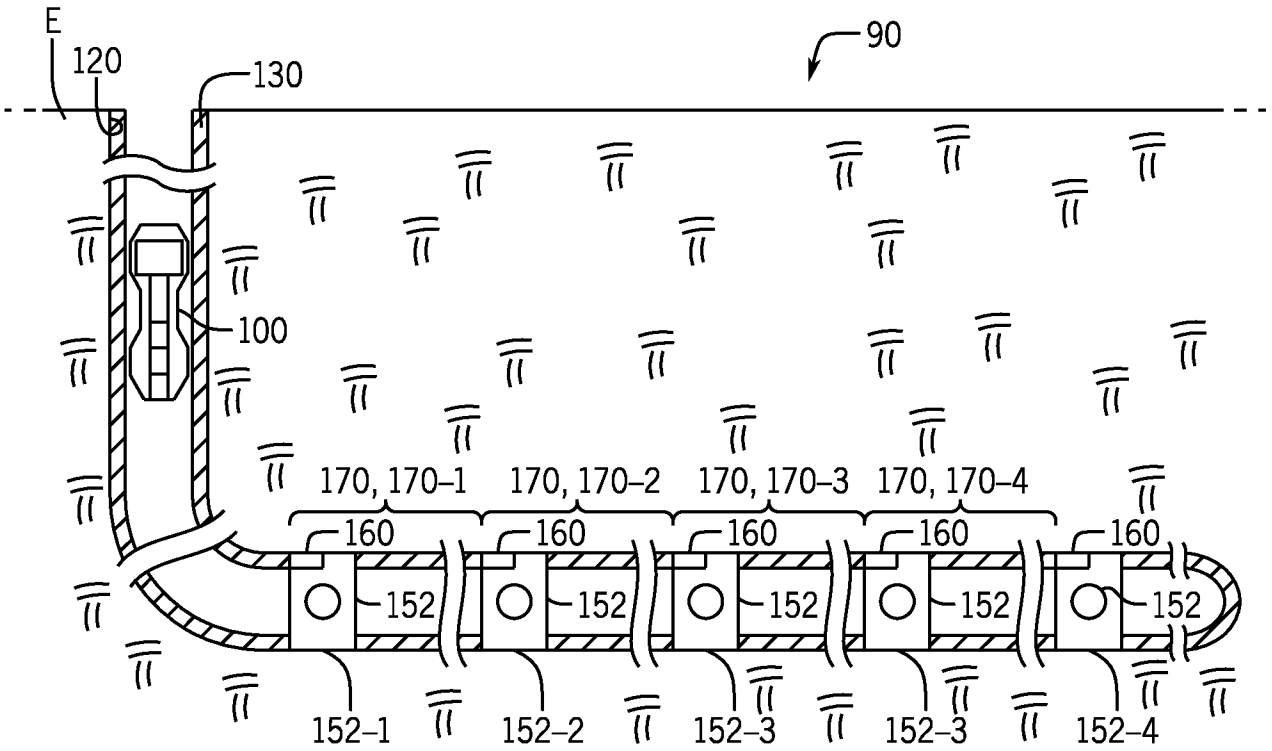
FIG. 1 is a schematic diagram of a multiple stage well according to an example implementation.

In general, systems and techniques are disclosed herein for purposes of deploying an untethered object into a well and using an autonomous operation of the object to perform a downhole operation. In this context, an "untethered object" refers to an object that travels at least some distance in a well passageway without being attached to a conveyance mechanism (a slickline, wireline, coiled tubing string, and so forth). As specific examples, the untethered object may be a dart, a ball or a bar. However, the untethered object may take on different forms, in accordance with further implementations. In accordance with some implementations, the untethered object may be pumped into the well (i.e., pushed into the well with fluid), although pumping may not be employed to move the object in the well, in accordance with further implementations.

In general, the untethered object may be used to perform a downhole operation that may or may not involve actuation of a downhole tool As just a few examples, the downhole operation may be a stimulation operation (a fracturing operation or an acidizing operation as examples); an operation performed by a downhole tool (the operation of a downhole valve, the operation of a single shot tool, or the operation of a perforating gun, as examples); the formation of a downhole obstruction; or the diversion of fluid (the diversion of fracturing fluid into a surrounding formation, for example). Moreover, in accordance with example implementations, a single untethered object may be used to perform multiple downhole operations in multiple zones, or stages, of the well, as further disclosed herein.

In accordance with example implementations, the untethered object is deployed in a passageway (a tubing string passageway, for example) of the well, autonomously senses its position as it travels in the passageway, and upon reaching a given targeted downhole position, autonomously operates to initiate a downhole operation. The untethered object is initially radially contracted when the object is deployed into the passageway. The object monitors its position as the object travels in the passageway, and upon determining that it has reached a predetermined location in the well, the object radially expands. The increased cross-section of the object due to its radial expansion may be used to effect any of a number of downhole operations, such as shifting a valve, forming a fluid obstruction, actuating a tool, and so forth. Moreover, because the object remains radially contracted before reaching the predetermined location, the object may pass through downhole restrictions (valve seats, for example) that may otherwise "catch" the object, thereby allowing the object to be used in, for example, multiple stage applications in which the object is used in conjunction with seats of the same size so that the object selects which seat catches the object.

In general, the untethered object is constructed to sense its downhole position as it travels in the well and autonomously respond based on this sensing. As disclosed herein, the untethered object may sense its position based on features of the string, markers, formation characteristics, and so forth, depending on the particular implementation. As a more specific example, for purposes of sensing its downhole location, the untethered object may be constructed to, during its travel, sense specific points in the well, called "markers"

herein. Moreover, as disclosed herein, the untethered object may be constructed to detect the markers by sensing a property of the environment surrounding the object (a physical property of the string or formation, as examples). The markers may be dedicated tags or materials installed in the well for location sensing by the object or may be formed from features (sleeve valves, casing valves, casing collars, and so forth) of the well, which are primarily associated with downhole functions, other than location sensing. Moreover, as disclosed herein, in accordance with example implementations, the untethered object may be constructed to sense its location in other and/or different ways that do not involve sensing a physical property of its environment, such as, for example, sensing a pressure for purposes of identifying valves or other downhole features that the object traverses during its travel.

Referring to FIG. 1, as a more specific example, in accordance with some implementations, a multiple stage well 90 includes a wellbore 120, which traverses one or more formations (hydrocarbon bearing formations, for example). As a more specific example, the wellbore 120 may be lined, or supported, by a tubing string 130, as depicted in FIG. 1. The tubing string 130 may be cemented to the wellbore 120 (such wellbores typically are referred to as "cased hole" wellbores); or the tubing string 130 may be secured to the formation by packers (such wellbores typically are referred to as "open hole" wellbores). In general, the wellbore 120 extends through one or multiple zones, or stages 170 (four stages 170-1, 170-2, 170-3 and 170-4, being depicted as examples in FIG. 1) of the well 90.

It is noted that although FIG. 1 depicts a laterally extending wellbore 120, the systems and techniques that are disclosed herein may likewise be applied to vertical wellbores. In accordance with example implementations, the well 90 may contain multiple wellbores, which contain tubing strings that are similar to the illustrated tubing string 130. Moreover, depending on the particular implementation, the well 90 may be an injection well or a production well. Thus, many variations are contemplated, which are within the scope of the appended claims.

In general, the downhole operations may be multiple stage operations that may be sequentially performed in the stages 170 in a particular direction (in a direction from the toe end of the wellbore 120 to the heel end of the wellbore 120, for example) or may be performed in no particular direction or sequence, depending on the implementation.

Although not depicted in FIG. 1, fluid communication with the surrounding reservoir may be enhanced in one or more of the stages 170 through, for example, abrasive jetting operations, perforating operations, and so forth.

In accordance with example implementations, the well 90 of FIG. 1 includes downhole tools 152 (tools 152-1, 152-2, 152-3 and 152-4, being depicted in FIG. 1 as examples) that are located in the respective stages 170. The tool 152 may be any of a variety of downhole tools, such as a valve (a circulation valve, a casing valve, a sleeve valve, and so forth), a seat assembly, a check valve, a plug assembly, and so forth, depending on the particular implementation. Moreover, the tool 152 may be different tools (a mixture of casing valves, plug assemblies, check valves, and so forth, for example).

A given tool 152 may be selectively actuated by deploying an untethered object through the central passageway of the tubing string 130. In general, the untethered object has a radially contracted state to permit the object to pass relatively freely through the central passageway of the tubing string 130 (and thus, through tools of the string 130), and the object has a radially expanded state, which causes the object to land in, or, be "caught" by, a selected one of the tools 152 or otherwise secured at a selected downhole location, in general, for purposes of performing a given downhole operation. For example, a given downhole tool 152 may catch the untethered object for purposes of forming a downhole obstruction to divert fluid (divert fluid in a fracturing or other stimulation operation, for example); pressurize a given stage 170; shift a sleeve of the tool 152; actuate the tool 152; install a check valve (part of the object) in the tool 152; and so forth, depending on the particular implementation.

For the specific example of FIG. 1, the untethered object is a dart 100, which, as depicted in FIG. 1, may be deployed (as an example) from the Earth surface E into the tubing string 130 and propagate along the central passageway of the string 130 until the dart 100 senses proximity of the targeted tool 152 (as further disclosed herein), radially expands and engages the tool 152. It is noted that the dart 100 may be deployed from a location other than the Earth surface E, in accordance with further implementations. For example, the dart 100 may be released by a downhole tool. As another example, the dart 100 may be run downhole on a conveyance mechanism and then released downhole to travel further downhole untethered.

In accordance with an example implementation, the tools 152 may be sleeve valves that may be initially closed when run into the well 90 but subsequently shifted open when engaged by the dart 100 for purposes for performing fracturing operations from the heel to the toe of the wellbore 120 (for the example stages 170-1, 170-2, 170-3 and 170-4 depicted in FIG. 1). In this manner, for this example, before being deployed into the wellbore 120, the dart 100 is configured, or programmed, to sequentially target the tools 152 of the stages 170-1, 170-2, 170-3 and 170-4 in the order in which the dart 100 encounters the tools 152.

Continuing the example, the dart 100 is released into the central passageway of the tubing string 130 from the Earth surface E, travels downhole in the tubing string 130, and when the dart 100 senses proximity of the tool 152 of the stage 170-1 along the dart's path, the dart 100 radially expands to engage a dart catching seat of the tool 152. Using the resulting fluid barrier, or obstruction, that is created by the dart 100 landing in the tool 152, fluid pressure may be applied uphole of the dart 100 (by pumping fluid into the tubing string 130, for example) for purposes of creating a force to shift the sleeve of the tool 152 (a sleeve valve, for this example) to open radial fracture ports of the tool 152 with the surrounding formation in the stage 170-1.

The dart 100 is constructed to subsequently radially contract to release itself from the tool 152 (as further disclosed herein) of the stage 170-1, travel further downhole through the tubing string 130, radially expand in response to sensing proximity of the tool 152 of the stage 170-2, and land in the tool of the stage 170-2 to create another fluid obstruction. Using this fluid obstruction, the portion of the tubing string 130 uphole of the dart 100 may be pressurized for purposes of fracturing the stage 170-1 and shifting the sleeve valve of the stage 170-2 open. Thus, the above-described process repeats in the heel-to-toe fracturing, in accordance with an example implementation, as the fracturing proceeds downhole until the stage 170-4 is fractured. It is noted that although FIG. 1 depicts four stages 170-1, 170-2, 170-3 and 170-4, the heel-to-toe fracturing may be performed in fewer or more than four stages, in accordance with further implementations.

Although examples are disclosed herein in which the dart 100 is constructed to radially expand at the appropriate time so that a tool 152 of the string 130 catches the dart 100, in accordance with other implementations disclosed herein, the dart 100 may be constructed to secure itself to an arbitrary position of the string 130, which is not part of a tool 152. Thus, many variations are contemplated, which are within the scope of the appended claims.

For the example that is depicted in FIG. 1, the dart 100 is deployed in the tubing string 130 from the Earth surface E for purposes of engaging one of the tool 152 (i.e., for purposes of engaging a "targeted tool 152"). The dart 100 autonomously senses its downhole position, remains radially contracted to pass through tool(s) 152 (if any) uphole of the targeted tool 152, and radially expands before reaching the targeted tool 152. In accordance with some implementations, the dart 100 senses its downhole position by sensing the presence of markers 160 which may be distributed along the tubing string 130.

For the specific example of FIG. 1, each stage 170 contains a marker 160, and each marker 160 is embedded in a different tool 152. The marker 160 may be a specific material, a specific downhole feature, a specific physical property, a radio frequency (RF) identification (RFID), tag, and so forth, depending on the particular implementation.

It is noted that each stage 170 may contain multiple markers 160; a given stage 170 may not contain any markers 160; the markers 160 may be deployed along the tubing string 130 at positions that do not coincide with given tools 152; the markers 160 may not be evenly/regularly distributed as depicted in FIG. 1; and so forth, depending on the particular implementation. Moreover, although FIG. 1 depicts the markers 160 as being deployed in the tools 152, the markers 160 may be deployed at defined distances with respect to the tools 152, depending on the particular implementation. For example, the markers 160 may be deployed between or at intermediate positions between respective tools 152, in accordance with further implementations. Thus, many variations are contemplated, which are within the scope of the appended claims.

In accordance with an example implementation, a given marker 160 may be a magnetic material-based marker, which may be formed, for example, by a ferromagnetic material that is embedded in or attached to the tubing string 130, embedded in or attached to a given tool housing, and so forth. By sensing the markers 160, the dart 100 may determine its downhole position and selectively radially expand accordingly. As further disclosed herein, in accordance with an example implementation, the dart 100 may maintain a count of detected markers. In this manner, the dart 100 may sense and log when the dart 100 passes a marker 160 such that the dart 100 may determine its downhole position based on the marker count.

Thus, the dart 100 may increment (as an example) a marker counter (an electronics-based counter, for example) as the dart 100 traverses the markers 160 in its travel through the tubing string 130; and when the dart 100 determines that a given number of markers 160 have been detected (via a threshold count that is programmed into the dart 100, for example), the dart 100 radially expands.

For example, the dart 100 may be launched into the well 90 for purposes of being caught in the tool 152-3. Therefore, given the example arrangement of FIG. 1, the dart 100 may be programmed at the Earth surface E to count two markers 160 (i.e., the markers 160 of the tools 152-1 and 152-2) before radially expanding. The dart 100 passes through the tools 152-1 and 152-2 in its radially contracted state; increments its marker counter twice due to the detection of the markers 152-1 and 152-2; and in response to its marker counter indicating a "2," the dart 100 radially expands so that the dart 100 has a cross-sectional size that causes the dart 100 to be "caught" by the tool 152-3.

Figure 2:
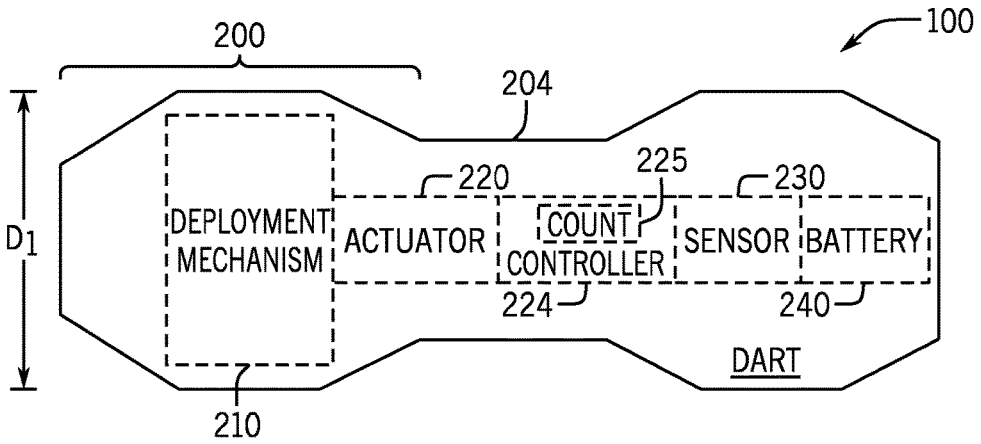
FIG. 2 is a schematic diagram of a dart of FIG. 1 in a radially contracted state according to an example implementation.
Figure 3:
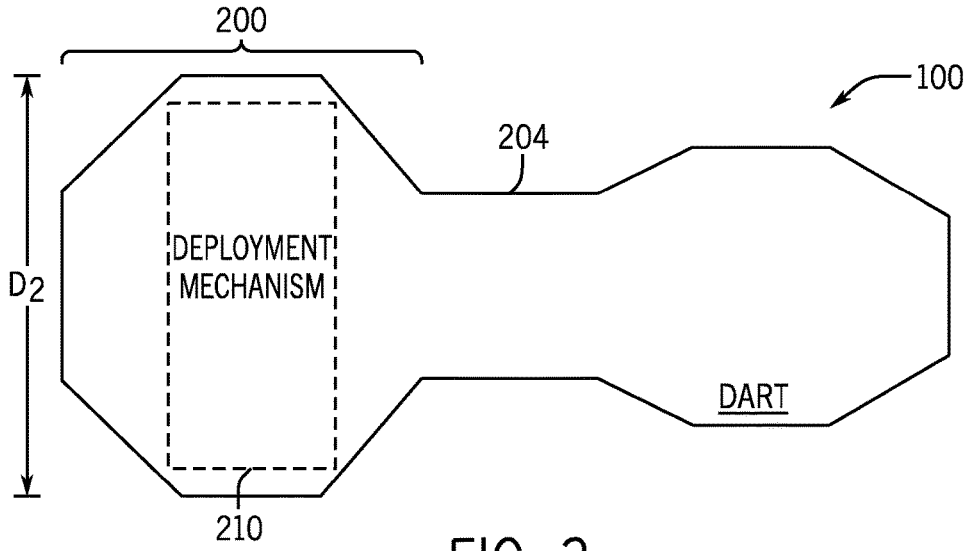
FIG. 3 is a schematic diagram of the dart of FIG. 1 in a radially expanded state according to an example implementation.

Referring to FIG. 2, in accordance with an example implementation, the dart 100 includes a body 204 having a section 200, which is initially radially contracted to a cross-sectional diameter D1 when the dart 100 is first deployed in the well 90. The dart 100 autonomously senses its downhole location and autonomously expands the section 200 to a radially larger cross-sectional diameter D2 (as depicted in FIG. 3) for purposes of causing the next encountered tool 152 to catch the dart 100.

As depicted in FIG. 2, in accordance with an example implementation, the dart 100 include a controller 224 (a microcontroller, microprocessor, field programmable gate array (FPGA), or central processing unit (CPU), as examples), which receives feedback as to the dart's position and generates the appropriate signal(s) to control the radial expansion of the dart 100. As depicted in FIG. 2, the controller 224 may maintain a count 225 of the detected markers, which may be stored in a memory (a volatile or a non-volatile memory, depending on the implementation) of the dart 100.

In this manner, in accordance with an example implementation, the sensor 230 provides one or more signals that indicate a physical property of the dart's environment (a magnetic permeability of the tubing string 130, a radioactivity emission of the surrounding formation, and so forth); the controller 224 use the signal(s) to determine a location of the dart 100; and the controller 224 correspondingly activates an actuator 220 to expand a deployment mechanism 210 of the dart 100 at the appropriate time to expand the cross-sectional dimension of the section 200 from the D1 diameter to the D2 diameter. As depicted in FIG. 2, among its other components, the dart 100 may have a stored energy source, such as a battery 240, and the dart 100 may have an interface (a wireless interface, for example), which is not shown in FIG. 2, for purposes of programming the dart 100 with a threshold marker count before the dart 100 is deployed in the well 90.

The dart 100 may, in accordance with example implementations, count specific markers, while ignoring other markers. In this manner, another dart may be subsequently launched into the tubing string 130 to count the previously-ignored markers (or count all of the markers, including the ignored markers, as another example) in a subsequent operation, such as a remedial action operation, a fracturing operation, and so forth. In this manner, using such an approach, specific portions of the well 90 may be selectively treated at different times. In accordance with some example implementations, the tubing string 130 may have more tools 152 (see FIG. 1), such as sleeve valves (as an example), than are needed for current downhole operations, for purposes of allowing future refracturing or remedial operations to be performed.

In accordance with example implementations, the sensor 230 senses a magnetic field. In this manner, the tubing string 130 may contain embedded magnets, and sensor 230 may be an active or passive magnetic field sensor that provides one or more signals, which the controller 224 interprets to detect the magnets. However, in accordance with further implementations, the sensor 230 may sense an electromagnetic coupling path for purposes of allowing the dart 100 to electromagnetic coupling changes due to changing geometrical features of the string 130 (thicker metallic sections due to tools versus thinner metallic sections for regions of the string 130 where tools are not located, for example) that are not attributable to magnets. In other example implementations, the sensor 230 may be a gamma ray sensor that senses a radioactivity. Moreover, the sensed radioactivity may be the radioactivity of the surrounding formation. In this manner, a gamma ray log may be used to program a corresponding location radioactivity-based map into a memory of the dart 100.

Figure 4:
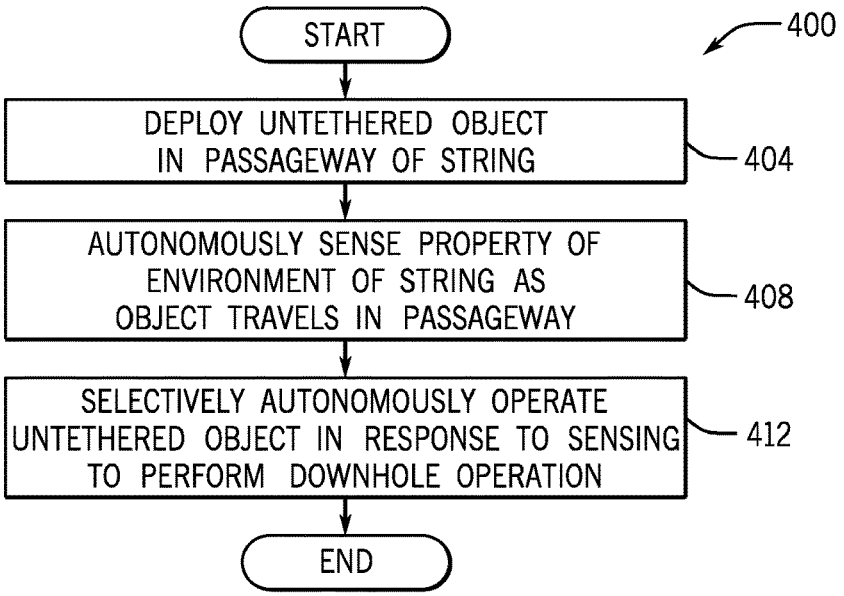
FIGS. 4, 6B and 14 are flow diagrams depicting techniques to autonomously operate an untethered object in a well to perform an operation in the well according to example implementations.

Regardless of the particular sensor 230 or sensors 230 used by the dart 100 to sense its downhole position, in general, the dart 100 may perform a technique 400 that is depicted in FIG. 4. Referring to FIG. 4, in accordance with example implementations, the technique 400 includes deploying (block 404) an untethered object, such as a dart, through a passageway of a string and autonomously sensing (block 408) a property of an environment of the string as the object travels in the passageway of the string. The technique 400 includes autonomously controlling the object to perform a downhole function, which may include, for example, selectively radially expanding (block 412) the untethered object in response to the sensing.

Figure 5:
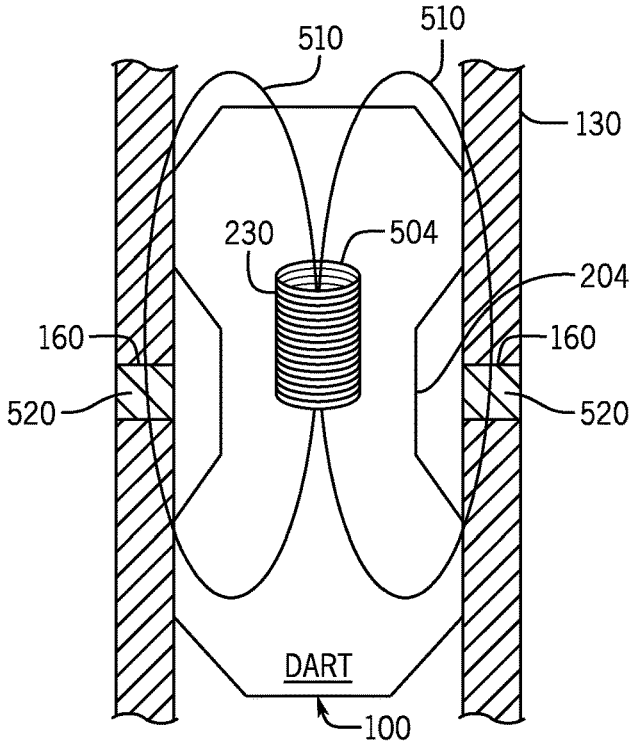
FIG. 5 is a schematic diagram of a dart illustrating a magnetic field sensor of the dart of FIG. 1 according to an example implementation.

Referring to FIG. 5 in conjunction with FIG. 2, in accordance with an example implementation, the sensor 230 of the dart 100 may include a coil 504 for purposes of sensing a magnetic field. In this manner, the coil 504 may be formed from an electrical conductor that has multiple windings about a central opening. When the dart passes in proximity to a ferromagnetic material 520, such as a magnetic marker 160 that contains the material 520, magnetic flux lines 510 of the material 520 pass through the coil 504. Thus, the magnetic field that is sensed by the coil 504 changes in strength due to the motion of the dart 100 (i.e., the influence of the material 520 on the sensed magnetic field changes as the dart 100 approaches the material 520, coincides in location with the material 520 and then moves past the material 520). The changing magnetic field, in turn, induces a current in the coil 504. The controller 224 (see FIG. 2) may therefore monitor the voltage across the coil 504 and/or the current in the coil 504 for purposes of detecting a given marker 160. The coil 504 may or may not be pre-energized with a current (i.e., the coil 504 may passively or actively sense the magnetic field), depending on the particular implementation.

It is noted that FIGS. 2 and 5 depict a simplified view of the sensor 230 and controller 224, as the skilled artisan would appreciate that numerous other components may be used, such as an analog-to-digital converter (ADC) to convert an analog signal from the coil 504 into a corresponding digital value, an analog amplifier, and so forth, depending on the particular implementation.

In accordance with example implementations, the dart 100 may sense a pressure to detect features of the tubing string 130 for purposes of determining the location/downhole position of the dart 100. For example, referring to FIG. 6A, in accordance with example implementations, the dart 100 includes a differential pressure sensor 620 that senses a pressure in a passageway 610 that is in communication with a region 660 uphole from the dart 100 and a passageway 614 that is in communication with a region 670 downhole of the dart 100. Due to this arrangement, the partial fluid seal/obstruction that is introduced by the dart 100 in its radially contracted state creates a pressure difference between the upstream and downstream ends of the dart 100 when the dart 100 passes through a valve.

Figure 6A:
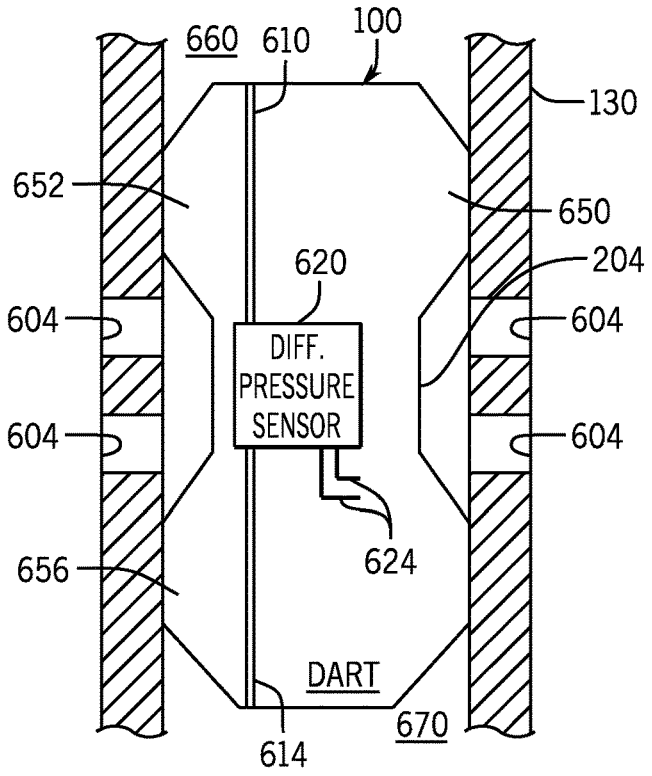
FIG. 6A is a schematic diagram illustrating a differential pressure sensor of the dart of FIG. 1 according to an example implementation.

For example, as shown in FIG. 6A, a given valve may contain radial ports 604. Therefore, for this example, the differential pressure sensor 620 may sense a pressure difference as the dart 100 travels due to a lower pressure below the dart 100 as compared to above the dart 100 due to a difference in pressure between the hydrostatic fluid above the dart 100 and the reduced pressure (due to the ports 604) below the dart 100. As depicted in FIG. 6A, the differential pressure sensor 620 may contain terminals 624 that, for example, electrically indicate the sensed differential pressure (provide a voltage representing the sensed pressure, for example), which may be communicated to the controller 224 (see FIG. 2). For these example implementations, valves of the tubing string 130 are effectively used as markers for purposes of allowing the dart 100 to sense its position along the tubing string 130.

Figure 6B:
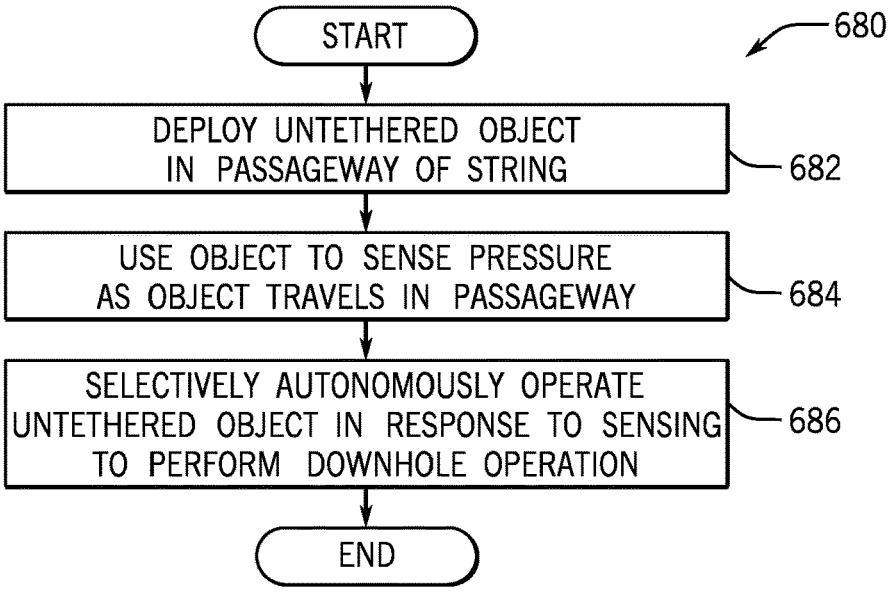

Therefore, in accordance with example implementations, a technique 680 that is depicted in FIG. 6B may be used to autonomously operate the dart 100. Pursuant to the technique 680, an untethered object is deployed (block 682) in a passageway of the string; and the object is used (block 684) to sense pressure as the object travels in a passageway of the string. The technique 680 includes selectively autonomously operating (block 686) the untethered object in response to the sensing to perform a downhole operation.

In accordance with some implementations, the dart 100 may sense multiple indicators of its position as the dart 100 travels in the string. For example, in accordance with example implementations, the dart 100 may sense both a physical property and another downhole position indicator, such as a pressure (or another property), for purposes of determining its downhole position. Moreover, in accordance with some implementations, the markers 160 (see FIG. 1) may have alternating polarities, which may be another position indicator that the dart 100 uses to assess/corroborate its downhole position. In this regard, magnetic-based markers 160, in accordance with an example implementation, may be distributed and oriented in a fashion such that the polarities of adjacent magnets alternate. Thus, for example, one marker 160 may have its north pole uphole from its south pole, whereas the next marker 160 may have its south pole uphole from its north pole; and the next the marker 160-3 may have its north pole uphole from its south pole; and so forth. The dart 100 may use the knowledge of the alternating polarities as feedback to verify/assess its downhole position.

Figure 7:
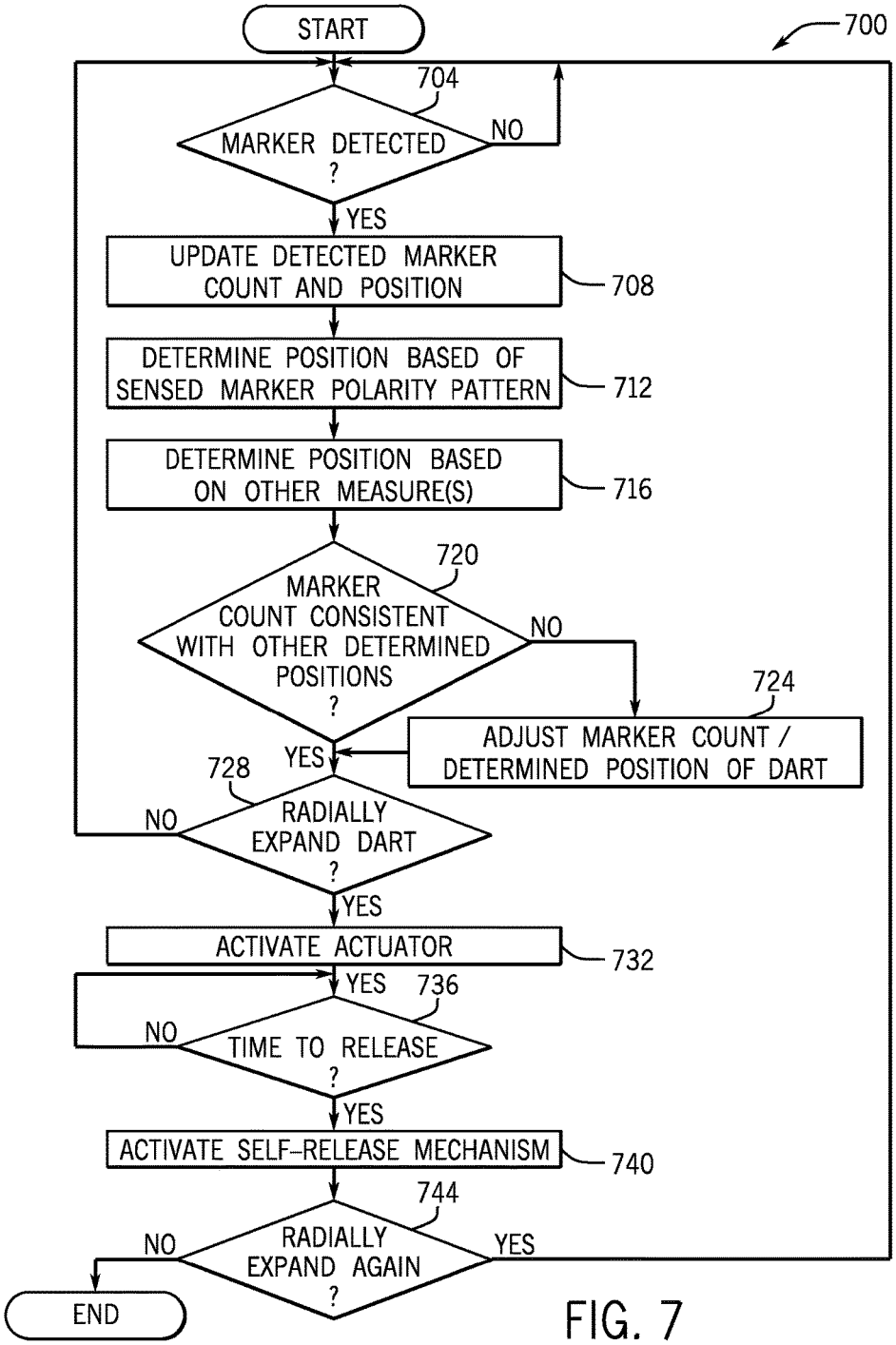
FIG. 7 is a flow diagram depicting a technique to autonomously operate a dart in a well to perform an operation in the well according to an example implementation.

Thus, referring to FIG. 7, in accordance with an example implementation, a technique 700 for autonomously operating an untethered object in a well, such as the dart 100, includes determining (decision block 704) whether a marker has been detected. If so, the dart 100 updates a detected marker count and updates its position, pursuant to block 708. The dart 100 further determines (block 712) its position based on a sensed marker polarity pattern, and the dart 100 may determine (block 716) its position based on one or more other measures (a sensed pressure, for example). If the dart 100 determines (decision block 720) that the marker count is inconsistent with the other determined position(s), then the dart 100 adjusts (block 724) the count/position. Next, the dart 100 determines (decision block 728) whether the dart 100 should radially expand the dart based on determined position. If not, control returns to decision block 704 for purposes of detecting the next marker.

If the dart 100 determines (decision block 728) that its position triggers its radially expansion, then the dart 100 activates (block 732) its actuator for purposes of causing the dart 100 to radially expand to at least temporarily secure the dart 100 to a given location in the tubing string 130. At this location, the dart 100 may or may not be used to perform a downhole function, depending on the particular implementation.

In accordance with example implementations, the dart 100 may contain a self-release mechanism. In this regard, in accordance with example implementations, the technique 700 includes the dart 100 determining (decision block 736) whether it is time to release the dart 100, and if so, the dart 100 activates (block 740) its self-release mechanism. In this manner, in accordance with example implementations, activation of the self-release mechanism causes the dart's deployment mechanism 210 (see FIGS. 2 and 3) to radially contract to allow the dart 100 to travel further into the tubing string 130. Subsequently, after activating the self-release mechanism, the dart 100 may determine (decision block 744) whether the dart 100 is to expand again or whether the dart has reached its final position. In this manner, a single dart 100 may be used to perform multiple downhole operations in potentially multiple stages, in accordance with example implementations. If the dart 100 is to expand again (decision block 744), then control returns to decision block 704.

Figure 8A:
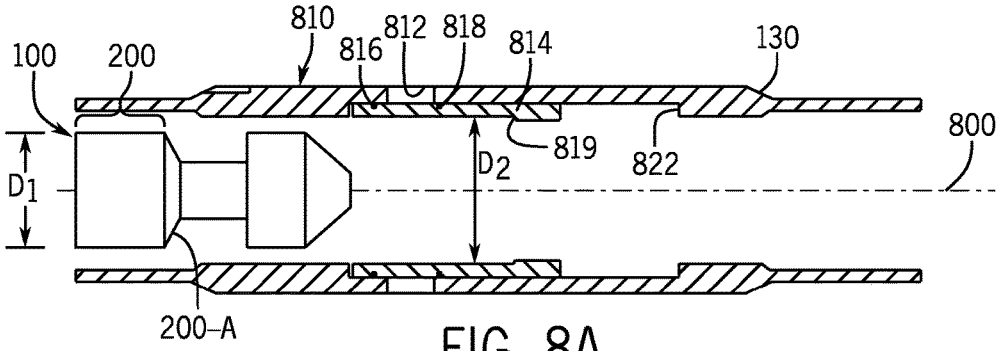
FIGS. 8A and 8B are cross-sectional views illustrating use of the dart to operate a valve according to an example implementation.
Figure 8B:
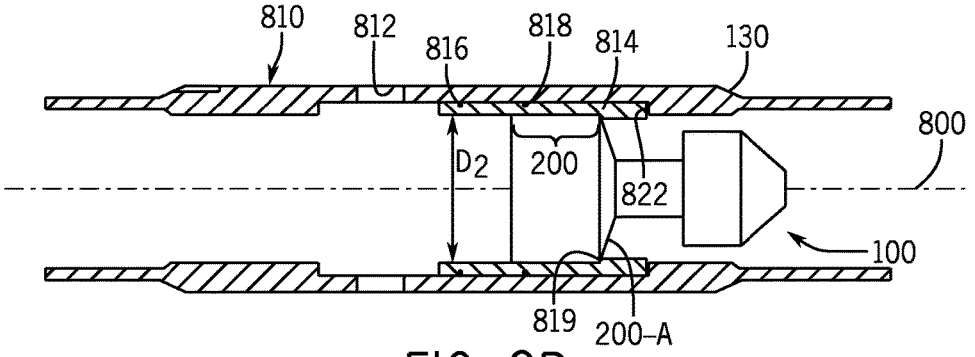

As a more specific example, FIGS. 8A and 8B depict engagement of the dart 100 with a valve assembly 810 of the tubing string 130. As an example, the valve assembly 810 may be a casing valve assembly, which is run into the well 90 closed and which may be opened by the dart 100 for purposes of opening fluid communication between the central passageway of the string 130 and the surrounding formation. For example, communication with the surrounding formation may be established/opened through the valve assembly 810 for purposes of performing a fracturing operation.

In general, the valve assembly 810 includes radial ports 812 that are formed in a housing of the valve assembly 810, which is constructed to be part of the tubing string 130 and generally circumscribe a longitudinal axis 800 of the assembly 810. The valve assembly 810 includes a radial pocket 822 to receive a corresponding sleeve 814 that may be moved along the longitudinal axis 800 for purposes of opening and closing fluid communication through the radial ports 812. In this manner, as depicted in FIG. 8A, in its closed state, the sleeve 814 blocks fluid communication between the central passageway of the valve assembly 810 and the radial ports 812. In this regard, the sleeve 814 closes off communication due to seals 816 and 818 (o-ring seals, for example) that are disposed between the sleeve 814 and the surrounding housing of the valve assembly 810.

As depicted in FIG. 8A, in general, the sleeve 814 has an inner diameter D2, which generally matches the expanded D2 diameter of the dart 100. Thus, referring to FIG. 8B, when the dart 100 is in proximity to the sleeve 814, the dart 100 radially expands the section 200 to close to or at the diameter D2 to cause a shoulder 200-A of the dart 100 to engage a shoulder 819 of the sleeve 814 so that the dart 100 becomes lodged, or caught in the sleeve 814, as depicted in FIG. 8B. Therefore, upon application of fluid pressure to the dart 100, the dart 100 translates along the longitudinal axis 800 to shift open the sleeve 814 to expose the radial ports 812 for purposes of transitioning the valve assembly 810 to the open state and allowing fluid communication through the radial ports 812.

In general, the valve assembly 810 depicted in FIGS. 8A and 8B is constructed to catch the dart 100 (assuming that the dart 100 expands before reaching the valve assembly 810) and subsequently retain the dart 100 until (and if) the dart 100 engages a self-release mechanism.

Figure 9A:
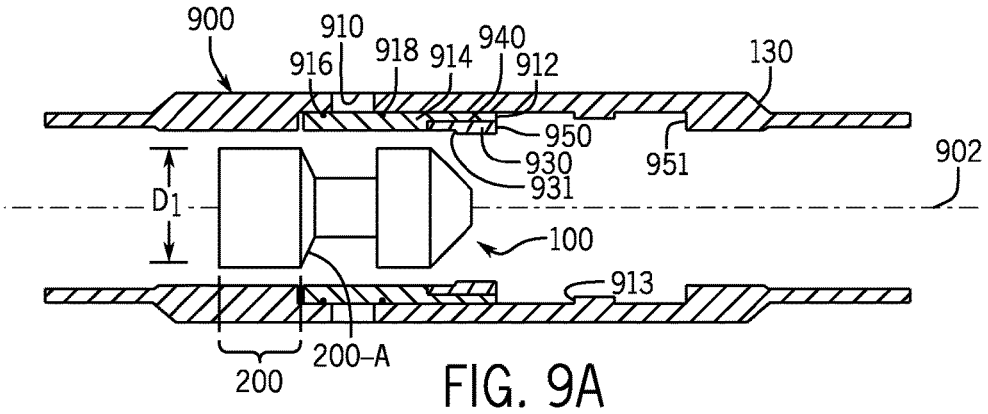
FIGS. 9A, 9B, 9C and 9D are cross-sectional views illustrating use of a dart to operate a valve assembly according to an example implementation.
Figure 9B:
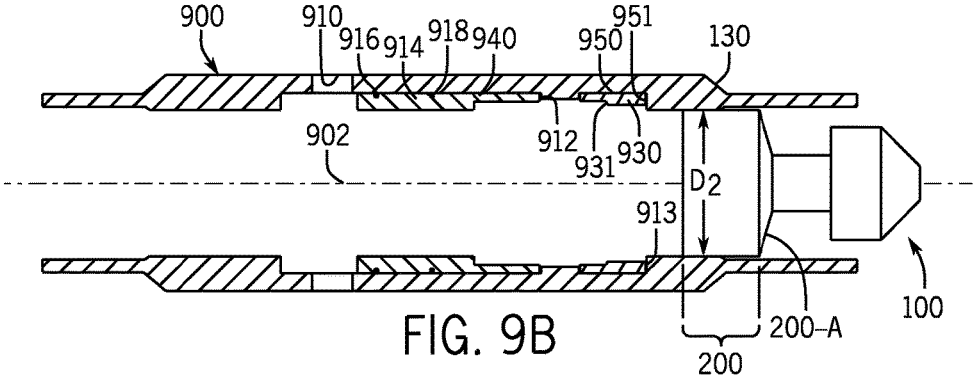

In accordance with some implementations, the valve assembly may contain a self-release mechanism, which is constructed to release the dart 100 after the dart 100 actuates the valve assembly. As an example, FIGS. 9A and 9B depict a valve assembly 900 that also includes radial ports 910 and a sleeve 914 for purposes of selectively opening and closing communication through the radial ports 910. In general, the sleeve 914 resides inside a radially recessed pocket 912 of the housing of the valve assembly 900, and seals 916 and 918 provide fluid isolation between the sleeve 914 and the housing when the valve assembly 900 is in its closed state. Referring to FIG. 9A, when the valve assembly 910 is in its closed state, a collet 930 of the assembly 910 is attached to and disposed inside a corresponding recessed pocket 940 of the sleeve 914 for purposes of catching the dart 100 (assuming that the dart 100 is in its expanded D2 diameter state). Thus, as depicted in FIG. 9A, when entering the valve assembly 900, the section 200 of the dart 100, when radially expanded, is sized to be captured inside the inner diameter of the collet 930 via the shoulder 200-A seating against a stop shoulder 913 of the pocket 912.

The securement of the section 200 of the dart 100 to the collet 930, in turn, shifts the sleeve 914 to open the valve assembly 900. Moreover, further translation of the dart 100 along the longitudinal axis 902 moves the collet 930 outside of the recessed pocket 940 of the sleeve 914 and into a corresponding recessed region 950 further downhole of the recessed region 912 where a stop shoulder 951 engages the collet 930. This state is depicted in FIG. 9B, which shows the collet 930 as being radially expanded inside the recess region 940. For this radially expanded state of the collet 930, the dart 100 is released, and allowed to travel further downhole.

Thus, in accordance with some implementations, for purposes of actuating, or operating, multiple valve assemblies, the tubing string 130 may contain a succession, or "stack," of one or more of the valve assemblies 900 (as depicted in FIGS. 9A and 9B) that have self-release mechanisms, with the very last valve assembly being a valve assembly, such as the valve assembly 800, which is constructed to retain the dart 100.

Figure 9C:
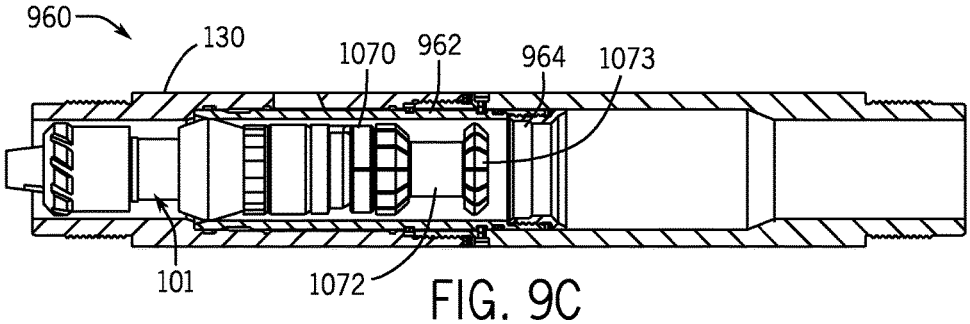
Figure 9D:
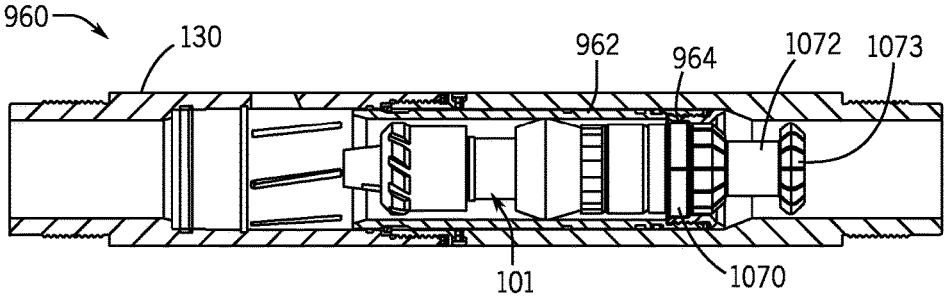

FIGS. 9C and 9D illustrate a dart 101 according to a further example implementation. For this example, the dart 101 is used to shift a valve assembly 960, with FIG. 9C illustrating the radially contracted dart 101 entering the valve assembly 960 and FIG. 9D illustrating the shifting of the valve assembly 960.

More specifically, referring to FIG. 9C, in accordance with example implementations, the dart 101 has a C-ring 1070, which the dart 101 radially expands for purposes of engaging an inner sleeve 962 of sleeve valve 960. In this regard, FIG. 9C depicts the dart 101 in proximity to a restricted profile, or seat 964, of the inner sleeve 962. FIG. 9D depicts engagement of the C-ring 1070 with the seat 964. In this engaged position, fluid pressure may be applied uphole of the dart 101 for purposes of shifting the inner sleeve 962 downhole to open radial flow ports (not shown) of the valve assembly 960.

Figure 10A:
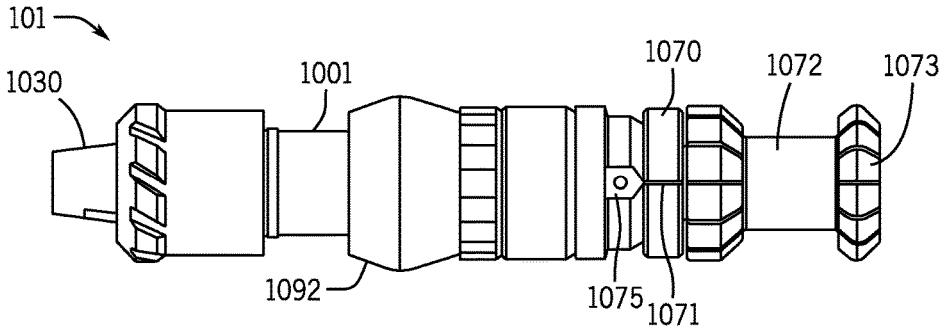
FIG. 10A is a perspective view of a dart according to an example implementation.

Referring to FIG. 10A, in general, the dart 101 has a tubular housing 1001 and an annular seal element 1092, which generally surrounds the housing 1001. As described further below, in accordance with example implementations, the dart 101 is constructed to retract an internal piston to cause the closure 1071 of the C-ring 1070 to impinge upon a spear 1075 that is fixed to the housing 1001 for purposes of radially expanding the ring 1070.

Figure 10B:
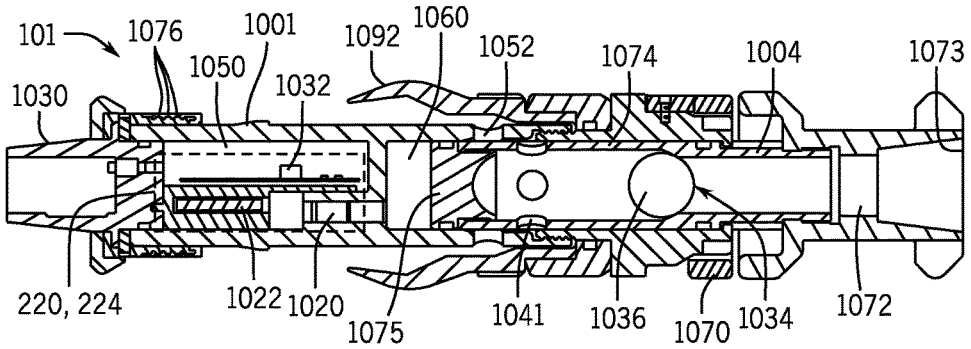
FIG. 10B is a cross-sectional view of the dart of FIG. 10A according to an example implementation.

Referring to FIG. 10B, in accordance with example implementations, the dart 101 includes a deployment mechanism that is formed from an atmospheric pressure chamber 1050 and a chamber 1060 that is initially isolated from the atmospheric pressure chamber 1050 and initially exerts a hydrostatic pressure against the piston 1075. More specifically, in accordance with an example implementation, the piston 1075 controls the alignment of radial ports 1052 of the housing 1001 and radial ports 1041 of a mandrel 1074 that is connected to the piston 1075. In the dart's radially contracted state, the piston 1075 is in a position to isolate the ports 1052 from the ports 1041. In this manner, in accordance with example implementations, a pressure chamber 1060 (a hydrostatic pressure chamber, for example) acts against the piston 1075 in a direction to keep the C-ring 1070 unexpanded.

In accordance with example implementations, to expand the C-ring 1070, the dart 101 reduces the pressure in the chamber 1060 to cause the piston 1075 to shift in the opposite direction. In this manner, the dart 101 radially expands the C-ring 1070 by opening fluid communication between the chamber 1060 and the atmospheric chamber 1050. This causes the piston 1075 to move into space 1060 and pull the C-ring 1070 into the spear 1075 may be radially expanded in response to fluid at hydrostatic pressure being communicated through the radial ports 1052.

For purposes of controlling fluid communication between chambers 1050 and 1060, the dart 101 includes a flow control device, such as a rupture disc 1020. The controller 224 selectively actuates the actuator 220 of the dart 101 for purposes of rupturing the rupture disc 1020 to establish communication with the atmospheric 1050 chamber for purposes of causing the mandrel 1080 to translate to expand the C-ring 1070.

As an example, in accordance with some implementations, the actuator 220 may include a linear actuator 1020, which, when activated by the controller 224, controls a linearly operable member to puncture the rupture disc 1020 for purposes of establishing communication with the atmospheric chamber 1050. In further implementations, the actuator 220 may include an exploding foil initiator (EFI) to activate a pyrotechnic material for purposes of puncturing the rupture disc 1020 (either directly or by forcing a projectile through the disc 1020 using the pressure generated by expanding gases, for example). The rupture disc 1020 may be an electric rupture disc. Moreover, communication path between the chambers may have an aperture, flutes, channels or other features to regulate fluid to flow from the hydrostatic chamber to the atmospheric chamber. Thus, many implementations are contemplated, which are within the scope of the appended claims.

Among its other features, as depicted in FIG. 10B, in accordance with example implementations, the dart 101 may include an electronic board 1032 that contains the circuitry for the controller 224 and a battery 1022 to provide power to the board 1032. The dart may further include windings 1076 that may form coils, and are used for purposes of sensing downhole features (valves, collars and so forth), as further described herein. In this manner, the windings 1076 may form one or more receiver coils (or antennae) of a balanced coil sensor or electromagnetic sensor, in general, in accordance with example implementations. More specifically, as further described herein, the controller 224 may process signals received from the receiver coils to identify downhole features, identify identification markers and determine a speed of the dart 101, among other functions. The dart 101 may further include a check valve 1034 that has a dissolvable ball 1036 for purposes of establishing downhole flow through the dart 101 after a predetermined time elapses to allow the dart 101 to be initially used to establish a fluid barrier to shift a valve assembly and divert fluid (such as in a fracturing operation). Additionally, as depicted in FIGS. 10A and 10B, in accordance with example implementations, the dart 101 may have a nose end 1072 with a receptacle 1073 to receive a tail end 1030 of another dart 101. Thus, multiple darts 101 may be stacked end-to-end, depending on the particular application in which the darts 101 are used.

Although the dart 101 is depicted as having a C-ring 1070 as its expandable deployment element, in general, the dart may have any of a number of different deployment elements, depending on the particular implementations. As other examples, the deployment element may be a collet sleeve, an inflatable bladder, an elastomer packer-type element that is compressed in response to the hydrostatic pressure, and so forth. Thus, many implementations are contemplated, which are within the scope of the appended claims.

In accordance with some example implementations, dart may have a self-release mechanism. For example, in accordance with example implementations, the dart may have a self-release mechanism that is formed from a reservoir and a metering valve, where the metering valve serves as a timer. In this manner, in response to the dart radially expanding, a fluid begins flowing into a pressure relief chamber. For example, the metering valve may be constructed to communicate a metered fluid flow between hydrostatic and atmospheric pressure chambers for purposes of resetting the deployment element of the dart to a radially contracted state to allow the dart to travel further into the well. As another example, in accordance with some implementations, one or more components of the dart, such as the deployment mechanism may be constructed of a dissolvable material, and the dart may release a solvent from a chamber at the time of its radial expansion to dissolve the mechanism.

Figure 11:
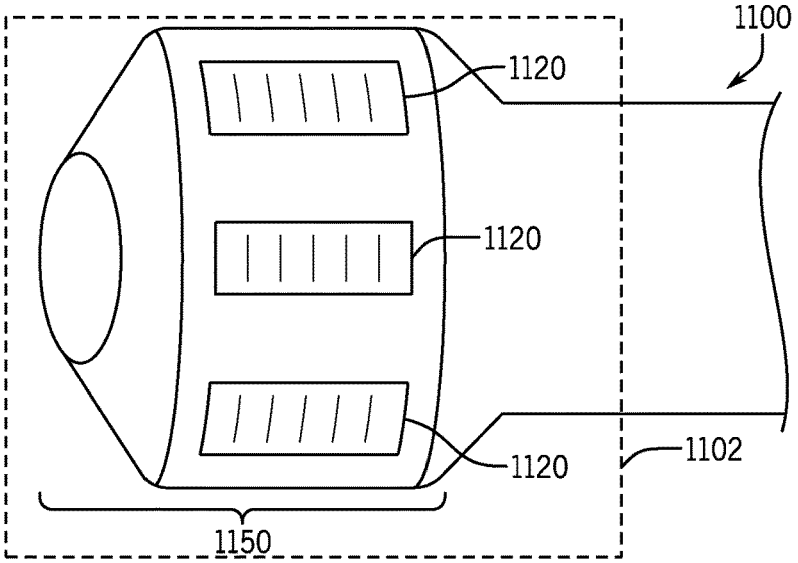
FIG. 11 is a perspective view of a deployment mechanism of the dart according to a further example implementation.

As yet another example, FIG. 11 depicts a portion of a dart 1100 in accordance with another example implementation. For this implementation, a deployment mechanism 1102 of the dart 1100 includes slips 1120, or hardened "teeth," which are designed to be radially expanded for purposes of gripping the wall of the tubing string 130, without using a special seat or profile of the tubing string 130 to catch the dart 1100. In this manner, the deployment mechanism 1102 may contains sleeves, or cones, to slide toward each other along the longitudinal axis of the dart to force the slips 1120 radially outwardly to engage the tubing string 130 and stop the dart's travel. Thus, many variations are contemplated, which are within the scope of the appended claims.

Figure 12:
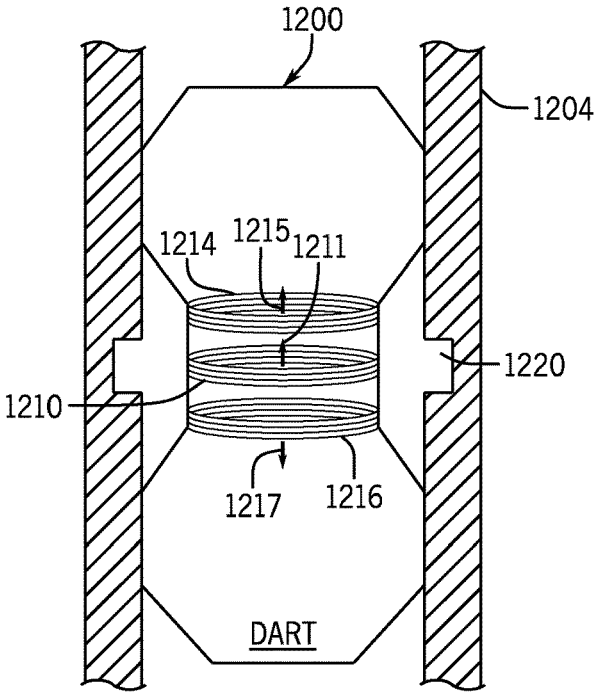
FIG. 12 is a schematic diagram of a dart illustrating an electromagnetic coupling sensor of the dart according to an example implementation.

Other variations are contemplated, which are within the scope of the appended claims. For example, FIG. 12 depicts a dart 1200 according to a further example implementation. In general, the dart 1200 includes an electromagnetic coupling sensor that is formed from two antennae, or receiver coils 1214 and 1216, and a transmitter coil 1210 that resides between the receiver coils 1215 and 1216. As shown in FIG. 12, the receiver coils 1214 and 1216 have respective magnetic moments 1215 and 1217, respectively, which are opposite in direction. It is noted that the moments 1215 and 1217 that are depicted in FIG. 12 may be reversed, in accordance with further implementations. As also shown in FIG. 12, the transmitter 1210 has an associated magnetic moment 1211, which is pointed upwardly in FIG. 12, but may be pointed downwardly, in accordance with further implementations.

In general, the electromagnetic coupling sensor of the dart 1200 senses geometric changes in a tubing string 1204 in which the dart 1200 travels. More specifically, in accordance with some implementations, the controller (not shown in FIG. 12) of the dart 1200 algebraically adds, or combines, the signals from the two receiver coils 1214 and 1216, such that when both receiver coils 1214 and 1216 have the same effective electromagnetic coupling the signals are the same, thereby resulting in a net zero voltage signal. However, when the electromagnetic coupling sensor passes by a geometrically varying feature of the tubing string 1204 (a geometric discontinuity or a geometric dimension change, such as a wall thickness change, for example), the signals provided by the two receiver coils 1214 and 1216 differ. This difference, in turn, produces a non-zero voltage signal, thereby indicating to the controller that a geometric feature change of the tubing string 1204 has been detected.

Such geometric variations may be used, in accordance with example implementations, for purposes of detecting certain geometric features of the tubing string 1204, such as, for example, sleeves or sleeve valves of the tubing string 1204. Thus, by detecting and possibly counting sleeves (or other tools or features), the dart 1200 may determine its downhole position and actuate its deployment mechanism accordingly.

Figure 13:
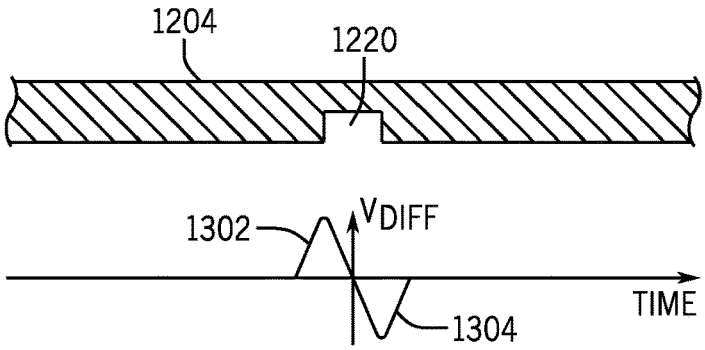
FIG. 13 is an illustration of a signal generated by the sensor of FIG. 12 according to an example implementation.

Referring to FIG. 13 in conjunction with FIG. 12, as a more specific example, an example signal is depicted in FIG. 13 illustrating a signature 1302 of the combined signal (called the "VDIFF" signal in FIG. 13) when the electromagnetic coupling sensor passes in proximity to an illustrated geometric feature 1220, such as an annular notch for this example.

Figure 14:
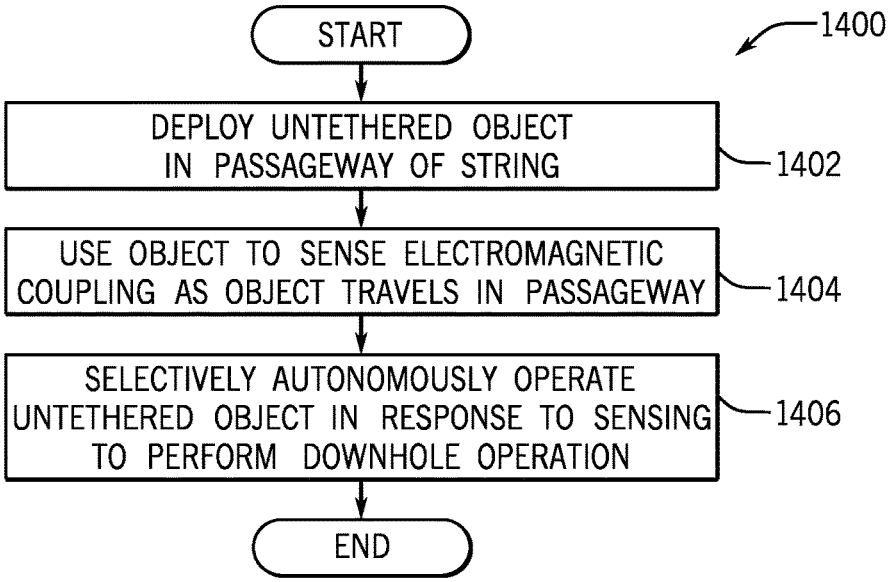

Thus, referring to FIG. 14, in accordance with example implementations, a technique 1400 includes deploying (block 1402) an untethered object and using (block 1404) the object to sense an electromagnetic coupling as the object travels in a passageway of the string. The technique 1400 includes selectively autonomously operating the untethered object in response to the sensing to perform a downhole operation, pursuant to block 1406.

Thus, in general, implementations are disclosed herein for purposes of deploying an untethered object through a passageway of the string in a well and sensing a position indicator as the object is being communicated through the passageway. The untethered object selectively autonomously operates in response to the sensing. As disclosed above, the property may be a physical property such as a magnetic marker, an electromagnetic coupling, a geometric discontinuity, a pressure or a radioactive source. In further implementations, the physical property may be a chemical property or may be an acoustic wave. Moreover, in accordance with some implementations, the physical property may be a conductivity. In yet further implementations, a given position indicator may be formed from an intentionally-placed marker, a response marker, a radioactive source, magnet, microelectromechanical system (MEMS), a pressure, and so forth. The untethered object has the appropriate sensor(s) to detect the position indicator(s), as can be appreciated by the skilled artisan in view of the disclosure contained herein.

Other implementations are contemplated and are within the scope of the appended claims. For example, in accordance with further example implementations, the dart may have a container that contains a chemical (a tracer, for example) that is carried into the fractures with the fracturing fluid. In this manner, when the dart is deployed into the well, the chemical is confined to the container. The dart may contain a rupture disc (as an example), or other such device, which is sensitive to the tubing string pressure such that the disc ruptures at fracturing pressures to allow the chemical to leave the container and be transported into the fractures. The use of the chemical in this manner allows the recovery of information during flowback regarding fracture efficiency, fracture locations, and so forth.

As another example of a further implementation, the dart may contain a telemetry interface that allows wireless communication with the dart. For example, a tube wave (an acoustic wave, for example) may be used to communicate with the dart from the Earth surface (as an example) for purposes of acquiring information (information about the dart's status, information acquired by the dart, and so forth) from the dart. The wireless communication may also be used, for example, to initiate an action of the dart, such as, for example, instructing the dart to radially expand, radially contract, acquire information, transmit information to the surface, and so forth.

Figure 15:
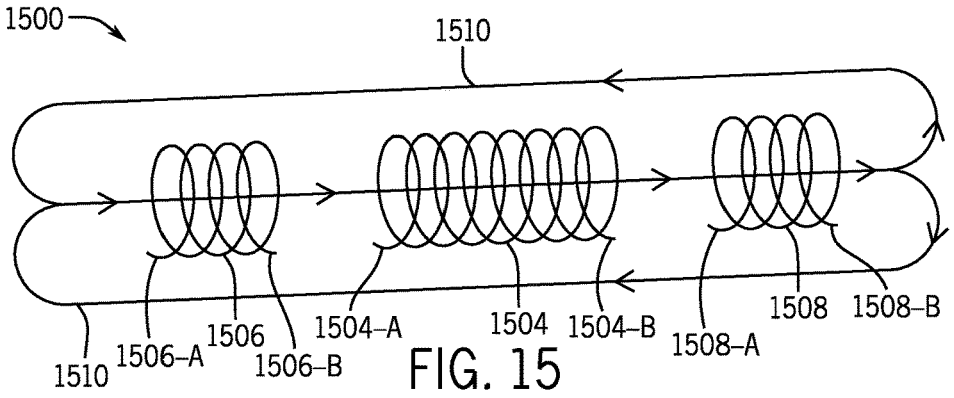
FIG. 15 is a schematic diagram illustrating a balanced coil sensor of a dart according to an example implementation.

In accordance with example implementations, the dart may contain a balanced coil sensor 1500 that is depicted in FIG. 15. The balanced coil sensor 1500 includes a magnetic field generator, or center coil 1504, which is energized, or driven, by the dart to produce a magnetic field (represented by flux lines 1510). In this manner the dart contains a driver that applies a voltage to terminals 1504-A and 1504-B of the coil 1504 to produce the magnetic field. This magnetic field, in turn, is influenced by the environment of the dart (the string 130 and its features, for example), and the magnetic field is sensed by receiver antennae, or receiver coils 1506 and 1508, of the balanced coil sensor 1500 to produce respective signals. In this manner, the receiver coils 1506 and 1508 may be disposed at equal distances (spaced apart at equal distances from the coil 1504 along the longitudinal axis of the dart, for example) such that the coil 1506 provides a signal across its terminals 1506-A and 1506-B, and the coil 1508 provides a signal across its terminals 1508-A and 1508-B. In accordance with example implementations, the coil 1504, 1506 and/or 1508 may be formed from the windings 1076 (see FIG. 10B), although, the coil 1504, 1506 and/or 1508 may be formed from windings of the dart that are disposed at other locations, in accordance with further, example implementations. The signals that are provided by the receiver coils 1506 and 1508 may differ at any point in time, depending on whether the influence of the surrounding tubing string 130. In this manner, if the balanced coil sensor 103 is within a uniform section of the tubing string 130 (such as in a straight pipe portion), then the signals are the same. However, the signals differ at a given time when the geometry of the string 130 through which the balanced coil sensor 1500 passes changes, as the magnetic field through each receiver coil 1506 is different.

Figure 16A:
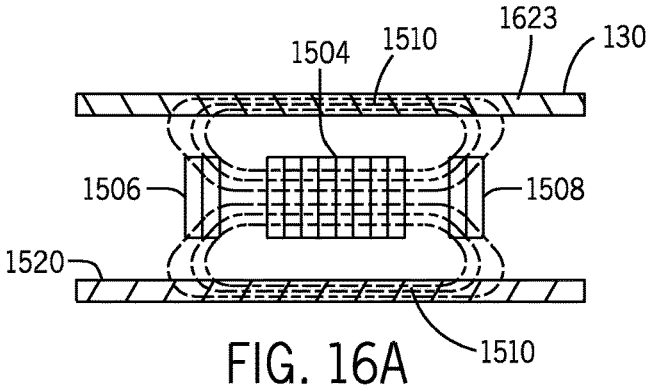
FIGS. 16A and 16B are illustrations of the balanced coil sensor in proximity to different downhole features according to example implementations.
Figure 16B:
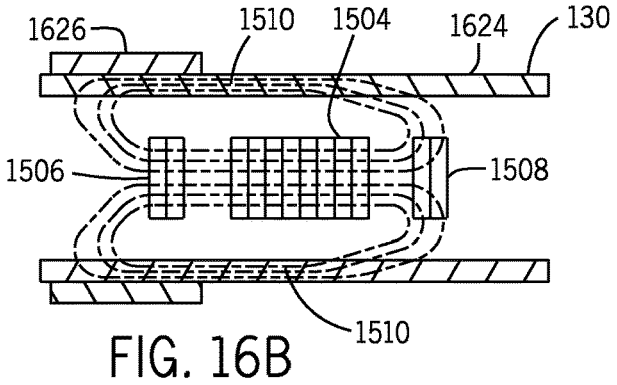

In this manner, referring to FIG. 16A, for the case in which the sensor is disposed inside a generally uniform tubular section 1623 of the tubing string 130, the flux lines 1501 are equally distributed; and as such, the coils 1506 and 1508 generally provide the same signals. Thus, the difference of the signals is zero, or small. This is to be contrasted to the case in which the balanced coil sensor 1500 propagates in a tubular member section, which has distributed features, such example section 1624 of FIG. 16B. For this example, the section 1624 has a thicker wall section 1624, which, as depicted in FIG. 16B causes the flux lines 1510 in the coils 1506 and 1508 to differ, thereby causing the coils 1506 and 1506 to produce different signals.

Figure 17A:
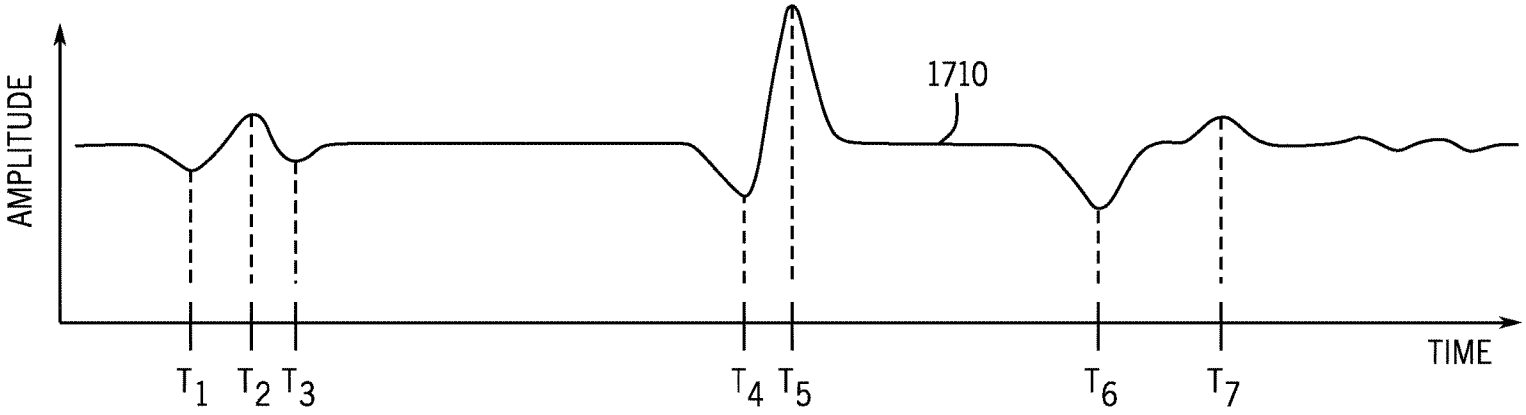
FIG. 17A is an illustration of a difference of signals provided by the balanced coil sensor according to an example implementation.
Figure 17B:
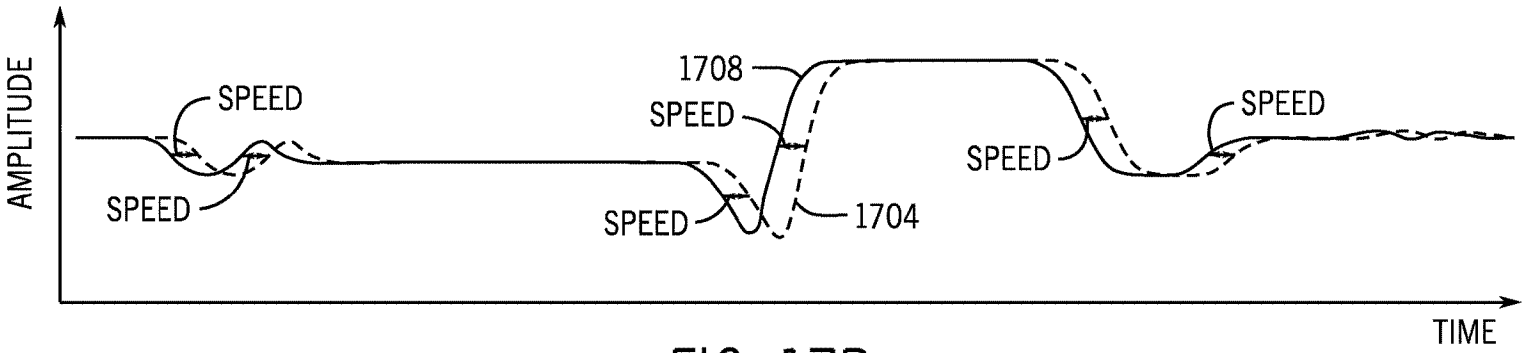
FIG. 17B is an illustration of signals provided by the balanced coil sensor according to an example implementation.

FIG. 17B depicts signals 1704 and 1708 that are generated by two receiver coils of a balanced coil sensor as a dart (or other untethered object carrying the sensor) propagates through the well. FIG. 17A depicts a difference 1710 of the signals 1704 and 1708. As discussed below, the difference may be used for purposes of identifying specific downhole features as well as determining a speed of the dart. In this manner, at times T1, T2, T3, T4, T5, T6 and T7 in FIG. 17A, the difference signal 1710 abruptly changes amplitude, thereby indicating a geometry change (i.e., a feature) of the tubing string 130. As depicted in FIG. 17B, the changes in the difference signal 1710 are associated with time shifts between the signals 1704 and 1708, as one receiver coil of the balanced coil sensor passes by the feature of the tubing string 130, and in a short time thereafter, the other coil of the balanced coil sensor passes by the feature. The time shift between the signals is a function of the speed of the dart.

Figure 18A:
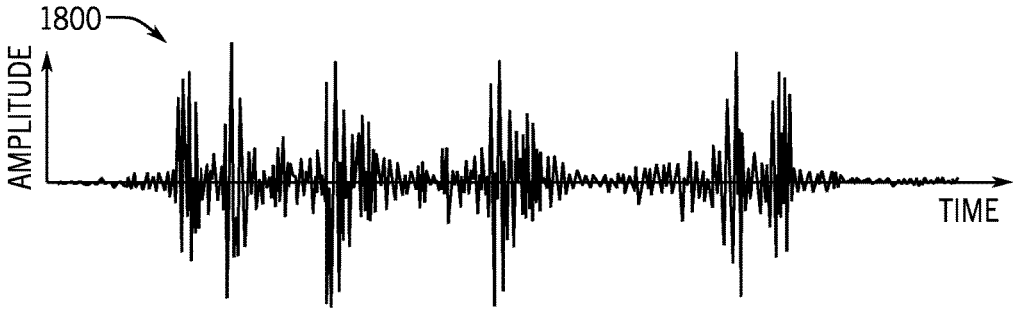
FIGS. 18A and 18B illustrate signals provided by a balanced coil sensor according to an example implementation.
Figure 18B:
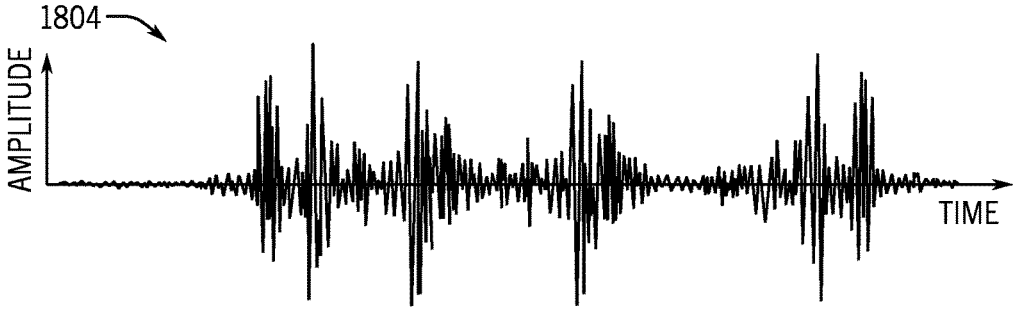

More specifically, FIGS. 18A and 18B depict two example signals 1800 and 1804 from the two receiver coils of a balanced coil sensor, in accordance with example implementations. For this example, the coil producing the signal 1804 is located uphole from the coil that produces the signal 1800 by a distance called "Δx" herein. The dart's speed and the time difference, or time shift (called "Δt") may be represented as follows:

$$\Delta t = \frac{\Delta x}{\text{speed}}. \qquad \text{Eq. 1}$$

As describe herein the dart's controller 224 may cross-correlate the receiver coil signals for such purposes as determining the time shift, determining a speed of the dart and identifying downhole features.

Figure 19:
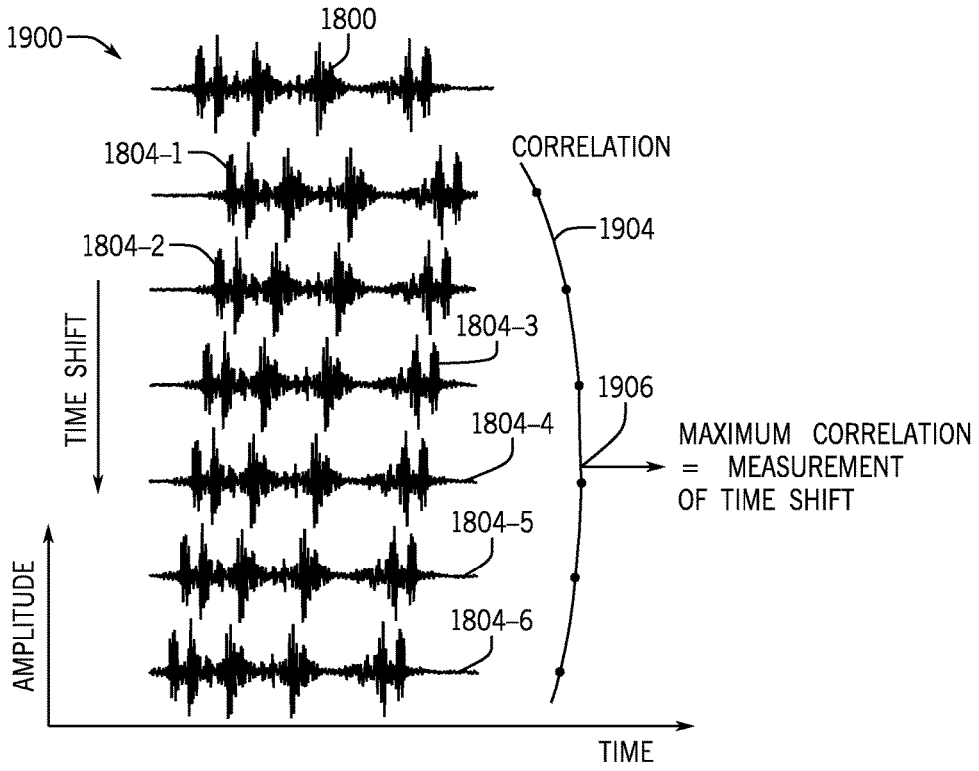
FIG. 19 is an illustration of a process to determine a time shift between sensed signals using cross-correlation according to an example implementation.

In accordance with example implementations, the controller 224 (see FIG. 2, for example) may apply a correlation process 1900 is illustrated in FIG. 19 for example receiver signals 1800 and 1804. Referring to FIG. 19, the correlation process 1900 involves cross-correlating the signal 1800 with candidate time-shifted versions (represented by time-shifted signals 1804-1, 1804-2, 1804-3, 1804-4, 1804-5 and 1804-6, in FIG. 19) of the other signal 1804 for purposes of deriving a correlation curve 1904. The correlation curve 1904 has a maximum correlation 1906. The maximum correlation 1906, in turn, corresponds to the time shift Δt between the receiver coil signals 1800 and 1804. Moreover, using the relationship of Eq. 1 and knowledge of a distance Δx between given features of the tubing string 130, the controller 224 may determine the speed of the dart as follows:

$$\text{speed} = \frac{\Delta x}{\Delta t \text{ at maximum correlation}}. \qquad \text{Eq. 2}$$

Figure 20:
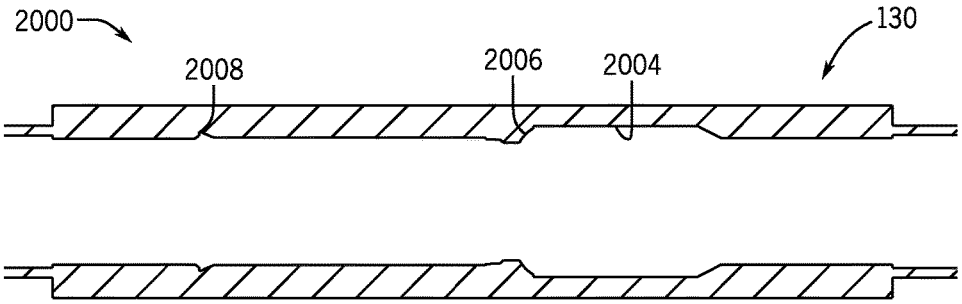
FIG. 20 is a cross-sectional view of an example section of a tubing string.
Figure 21:
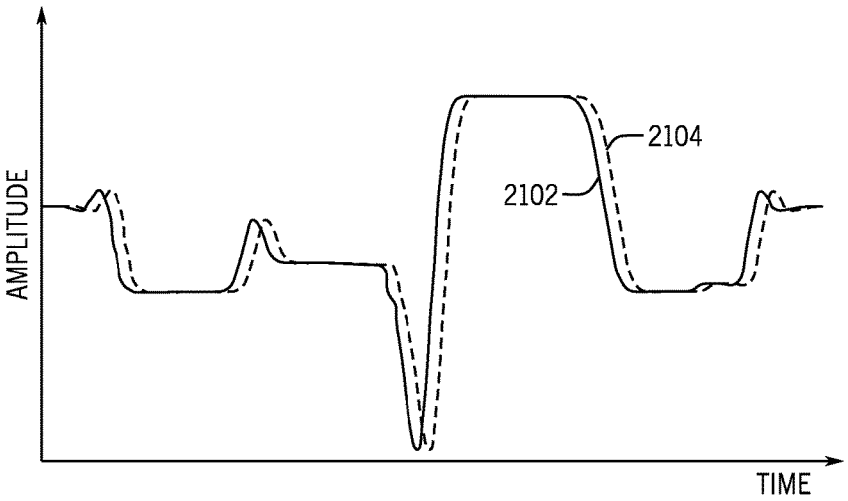
FIG. 21 illustrates signals provided by coils of a balanced coil sensor when passing through the tubing string section of FIG. 20 according to an example implementation.

FIG. 20 depicts an example downhole section 2000 of the tubing string 130, which has various geometric features 2004, 2006 and 2008 (as examples) which may be detected by a balanced coil sensor of a dart or other untethered object. In this regard, FIG. 21 depicts two corresponding signals 2102 and 2104 that may be generated by a balanced coil sensor as the object passes through the central passageway of the section 2000. Using a determined speed of the dart is determined, the controller 224 may use the receiver coil signals to identify specific downhole features.

Figure 22:
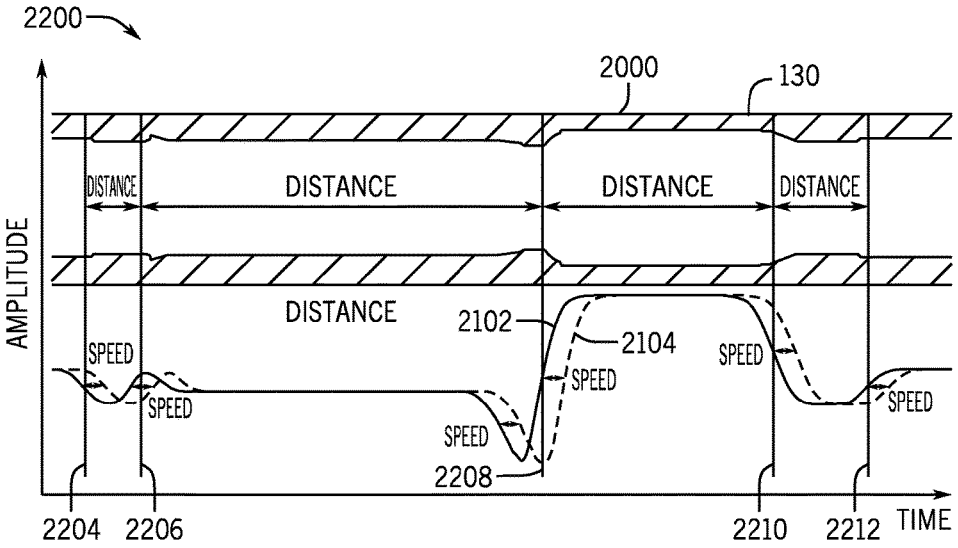
FIG. 22 is an illustration depicting a process to measure distances between features of a tubing string according to an example implementation.

An example process 2200 that may be used by the controller 224 for this purpose is depicted in FIG. 22. In FIG. 22 the section 200 superimposed on the signals 2102 and 2104 to depict amplitude changes in the signals 2102 and 2104 due to features 2204, 2204, 2208, 2210 and 2212 of the section 2000. As can be seen from FIG. 22, the signals respond to a given feature at slightly different times, which is due to one receiver coil passing the feature before the other. The controller 224 may use the signals 2102 and 2104, either singularly, or through a combination (via a difference signal, for example) to identify these features of the section 2000. For example, the controller 224 may identify a specific feature of the tubing string (or downhole equipment, in general) by determining the time for the balanced coil sensor to pass from one feature to the next, derive a distance between these features using the already-derived speed of the dart, and then using this distance (or a set of such distances) to identify downhole equipment. For example, the controller 224 may use this technique to identify sleeve valve assemblies so that the controller 224 may count sleeve valve assemblies through which the dart passes for purposes of determine when to expand the dart.

Figure 23:
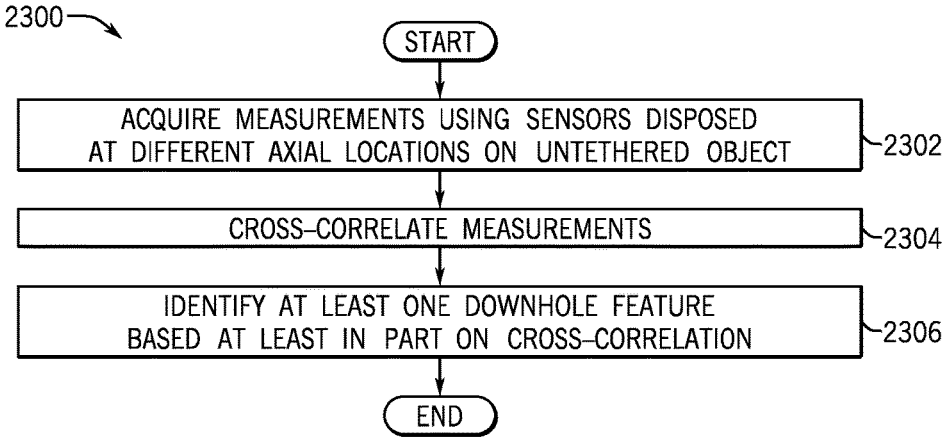
FIG. 23 is a flow diagram depicting a technique to use cross-correlation of sensor signals to identify a downhole feature according to an example implementation.

Referring to FIG. 23, to summarize, a technique 2300 in accordance with example implementations includes acquiring (block 2302) measurements using sensors that are disposed at different locations on an untethered object and cross-correlating (block 2304) the measurements. At least one downhole feature may then be identified (block 2306) based at least in part on the cross-correlation.

Figure 24A:
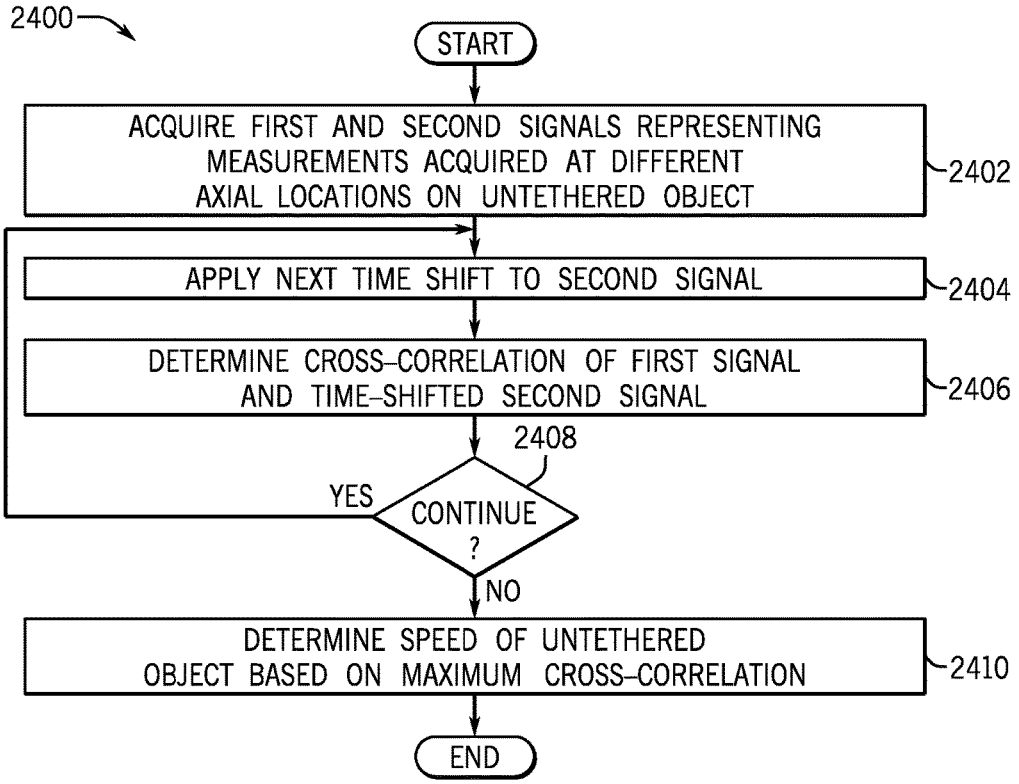
FIG. 24A is a flow diagram depicting a technique used by an untethered object to determine its speed according to an example implementation.
Figure 24B:
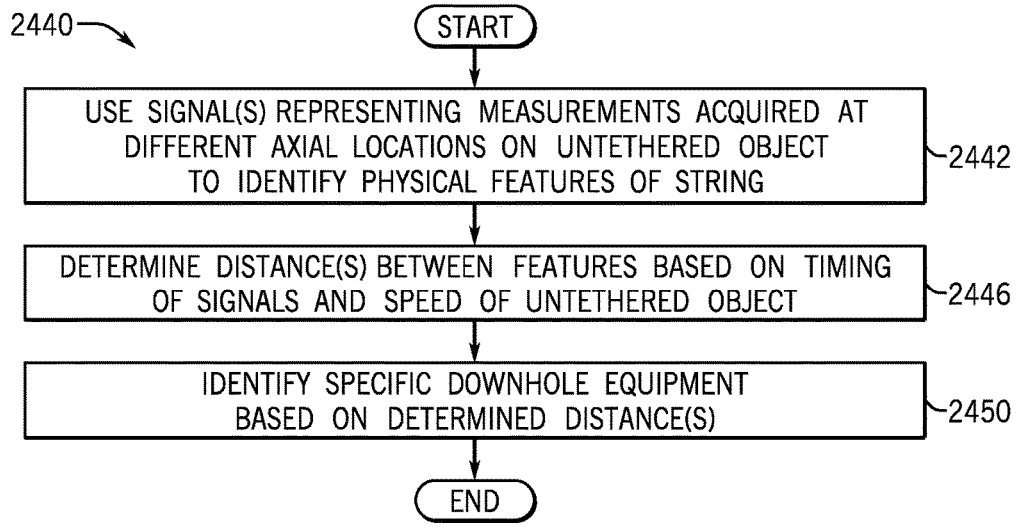
FIG. 24B is a flow diagram depicting a technique used by an untethered object to identify downhole equipment according to an example implementation.

As a more specific example, FIGS. 24A and 24B depict techniques to use a balanced coil sensor according to example implementations. Referring to FIG. 24A, a technique 2400 for determining the speed of the object includes acquiring (block 2402) first and second signals that represent measurements acquired at different axial locations on the untethered object and then proceeding with an iterative process to identify the time shift between the signals. In this manner, the technique 2400 includes applying (block 2404) the next time shift to the second measurement and determining (block 2406) a cross-correlation of the first signal and the time-shifted second signal. A determination is then made (decision block 2410) whether to continue the iterative process. In this regard, in accordance with some implementations, the cross-correlations may be logged and tracked so that the maximum correlation, or peak, may be identified. At this point, the time shift has been identified. When the decision is made (decision block 2410) to longer continue the process of finding the maximum correlation, the time shift has been identified, i.e., the time shift corresponds to the maximum correlation. At this point, the speed of the untethered object may be determined based at least in part on the maximum cross-correlation, as depicted in block 2416.

FIG. 24B depicts a technique 2440 for purposes of using the determined speed of the untethered object, along with signals provided by the balanced coil sensor for purposes of identifying specific downhole features. In this regard, the technique 2440 includes using (block 2442) signals representing measurements acquired at different axial locations on an untethered object to identify physical features of the string. One or more distances are then determined (block 2446) between the features based on the timing of the measurements and the speed of the untethered object. Specific downhole equipment may then be identified (block 2450) based at least in part on these determined distance(s).

It is noted that although the balanced coil sensor is described in the examples above, a number of different sensors other than receiver coils of a balanced coil sensor may be used for the above-described cross-correlation measurement processing. Moreover, sensors other than electromagnetic sensors may be used, in accordance with example implementations, such as acoustic and nuclear sensors, to name just a few. The cross-correlation techniques may, in general, provide a real time speed measurement or may be used in an autonomous mode with a downhole tool in general to allow the tool to independently determine its location and identify specific features of equipment downhole.

Figure 25A:
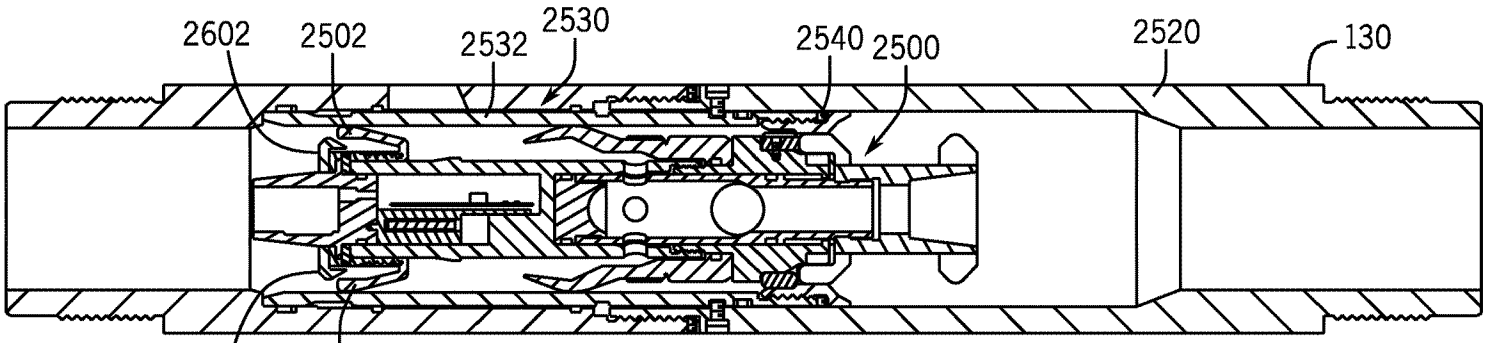
FIG. 25A is a schematic view illustrating a dart landing in a sleeve of a valve assembly according to an example implementation.
Figure 25B:
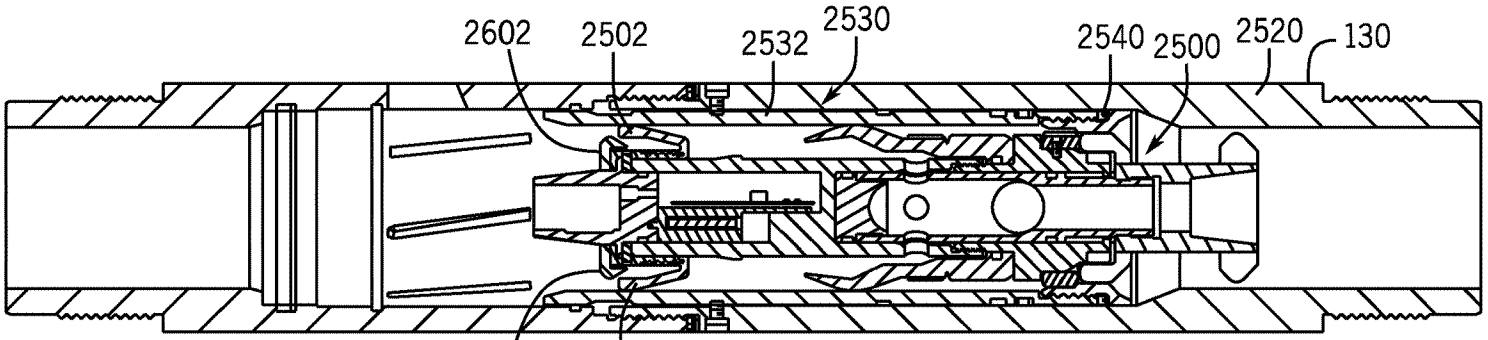
FIG. 25B is a cross-sectional view illustrating the shifting of the sleeve by the dart of FIG. 25A according to an example implementation.

Referring to FIG. 25A, in accordance with example implementations, a dart 2500 includes mechanically-actuated electrical switches 2602 for purposes of counting features (restrictions, for example) which serve as identification markers in the well. FIG. 25A depicts the dart 2500 when landed in an inner sleeve 2532 of a valve assembly 2520. For this example, the valve assembly 2520 includes a restriction, or seat 2540, which is engaged by a C-ring of the dart 2500. At its tail end, the dart 2500 includes multiple mechanically-actuated fingers 2502, which may be, for example, circumferentially arranged about the longitudinal axis of the dart 2500. Each finger 2502 for this example is connected at one end to the housing of the dart 2500 and has a free end at its other end for purposes of allowing the finger 2502 to be bent inwardly toward an associated switch 2602 to actuate the switch 2602 (transition the switch 2602 from an electrical open state to an electrical closed state, for example) when the finger 2502 enters a cross-sectional restriction of the tubing string 130. Referring to FIG. 25B, the dart 2500 may be shifted, in this example, for purposes of translating the sleeve 2532 of the valve assembly 2520.

Figure 26A:
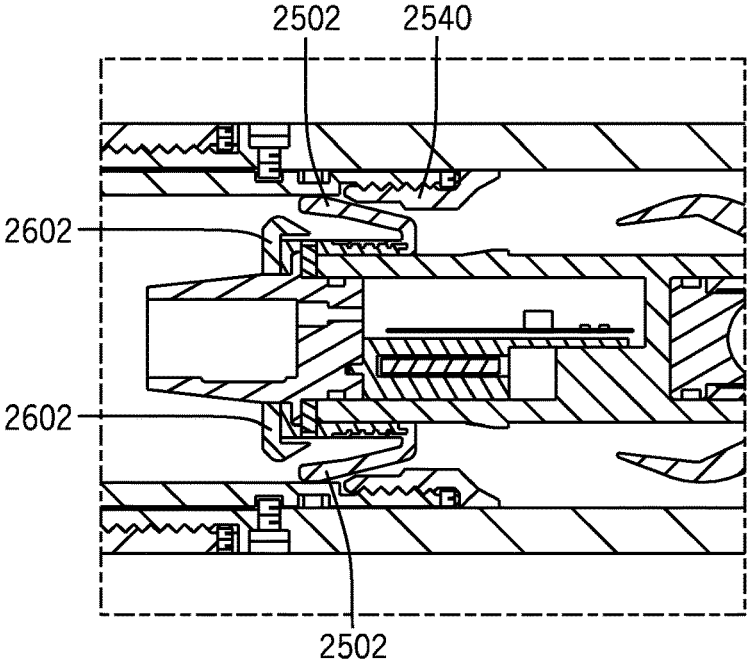
FIGS. 26A and 26B are schematic diagrams illustrating the use of mechanically-actuated switches of a dart to count downhole identification markers according to an example implementation.
Figure 26B:
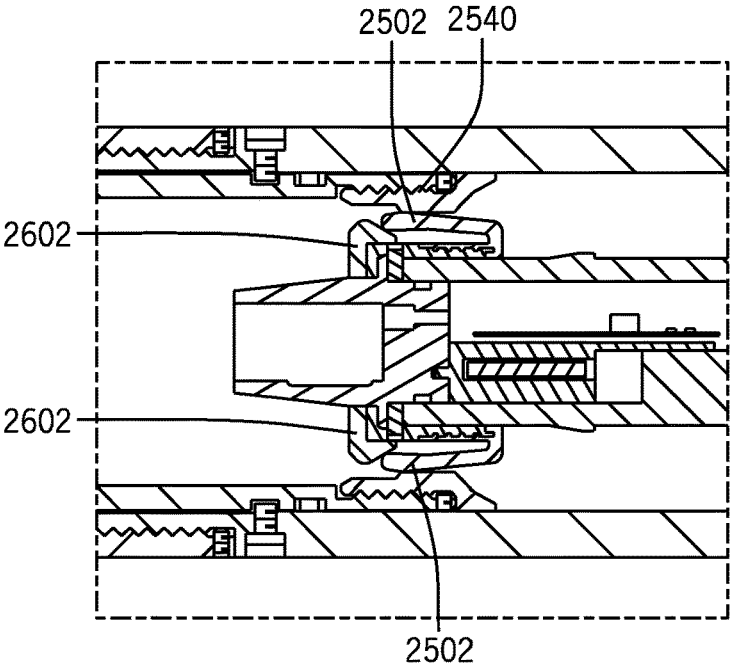

FIG. 26A depicts the fingers 2502 when in proximity to the valve seat 2540. As depicted in FIG. 26A, the dart 2500 includes mechanically-actuated switches 2602 that are located in proximity to associated members 2502. In this regard, as depicted in FIG. 26A, in accordance with example implementations, each mechanically-actuated switch 2602 may be associated with a corresponding finger 2502. The switch 2602 extends radially from the body of the dart 2500 so that when the finger 2502 extends inside the restriction 2540, as depicted in FIG. 26B, contact is made between the finger 2502 and the switch 2602 to actuate the switch 2602 (close the switch, for example).

Thus, as a given dart propagates through the passageway of a tubing string, switches of the dart may be momentarily engaged and released, which allows the dart 2500 to count the number of restrictions through which the dart passes. In accordance with example implementations, the dart 2500 may have a set of multiple circumferentially-arranged switches 2602 (and associated members 2502 so that a given feature is not detected by the dart 2500 until all of the switches of the set have been simultaneously actuated. Moreover, in accordance with some example implementations, the set of switches 2602 may be disposed at predetermined axial lengths along the axis of the dart 2500 so that predetermined features of downhole equipment cause the set of switches to be simultaneously engaged, thereby registering a count.

Figure 27:
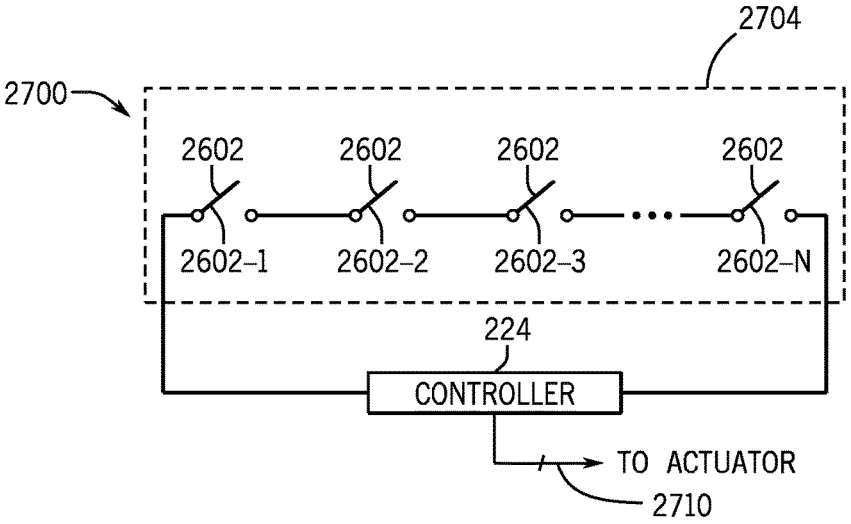
FIG. 27 is an electrical schematic diagram illustrating the use of mechanically-actuated switches to count downhole features according to an example implementation.

Thus, referring to FIG. 27, in accordance with some example implementations, the dart may contain circuitry 2700 for purposes of counting specific downhole features. The circuitry includes at least one set 2704 of switches 2602 (example switches 2602-1, 2602-2, 2602-3 . . . 2602-N, being depicted in FIG. 27), which are simultaneously actuated for purposes of forming a current path that is detected by the controller 224 for purposes of registering a count of an identified feature. In this manner, in response to detecting the closed current path, the controller 224 registers the event by incrementing a count (incrementing a count value that is stored by the controller 224, for example); and the controller 224 may use an actuator (via signal(s) provided on output terminal(s) 2710 of the controller 224) of the dart to radially expand the dart in response to the count reaching a predetermined value.

In general, proximity switches, such as the described switches 2602, or the like, may be implemented to count sleeve restrictions as the untethered object is going downhole. Assuming that the dart is be caught by the Nth sleeve valve assembly, after the dart reaches the N−1th sleeve, the controller 224 responds by radially expanding the dart. In accordance with example implementations, there may be multiple proximity switches tuned only to read a specific gap distance. For example, four switches may be used but it should be appreciated that any number of switches may be implemented. In the example, it may take a minimum of three switches to create a count. The fourth switch would, therefore, be a redundant switch in case one fails down hole. The distance may be dialed in to make a count once three switches were within the restriction diameter or where sensing proximity. If only two switches were sensing proximity, a count would not be registered because the other two switches would be too far away from the other walls. In other embodiments, a single proximity sensor may be configured to sense proximity to certain elements in a sleeve, valve or other downhole tool.

Figure 28:
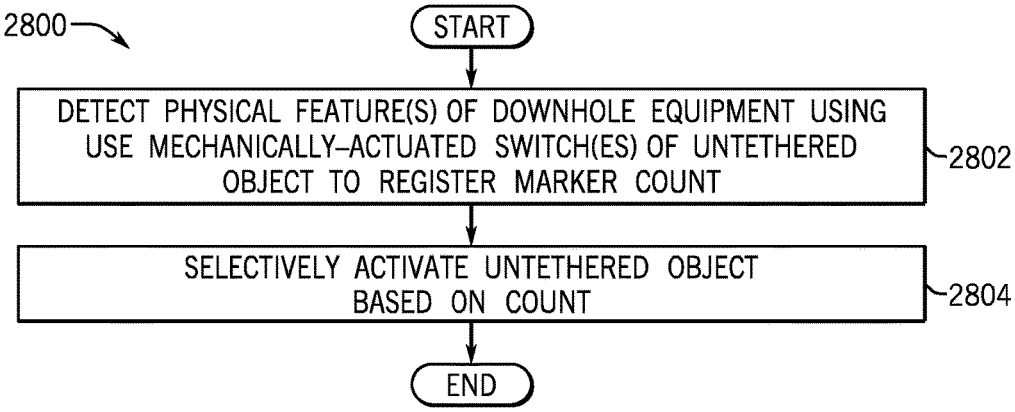
FIG. 28 is a flow diagram depicting a technique to use mechanically-actuated switches of an untethered object to regulate activation of the object according to an example implementation.

Referring to FIG. 28, to summarize, a technique 2800 in accordance with example implementations includes detecting one or more physical features of downhole equipment using mechanically-actuated switches of an untethered object, pursuant to block 2802. The technique 2800 includes selectively actuating the untethered object (selectively radially expanding the object, for example) based on the detected feature(s), pursuant to block 2804.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

deploying an untethered object through a passageway of a string in a well;

acquiring a plurality of measurements representing an environment of the string as the object is being communicated through the passageway;

cross-correlating the plurality of measurements; and using results of the cross-correlating to identify at least one downhole feature, wherein using the results of the cross-correlating comprises:

identifying a time shift between at least two measurements of the plurality of measurements; and using the identified time shift to determine a speed of the untethered object, and wherein using the result of the cross-correlating to identify the time shift comprises identifying the time shift based at least in part on a maximum of the cross-correlating evaluated at different candidate time shifts.

2. The method of claim 1, wherein using the result of the cross-correlating further comprises:

using at least two measurements of the plurality of measurements to identify times at which the object passes in proximity to at least two features of the string; and identifying a location of the object based at least in part on the speed and the times.

3. The method of claim 1, wherein acquiring the plurality of measurements comprises:

driving a first coil of the object to produce a magnetic field that is influenced by the string;

acquiring signals representing at least two of the measurements from second and third coils in response to the magnetic field.

4. The method of claim 3, wherein driving the first coil comprises driving a coil of a balanced coil sensor.

5. The method of claim 1, further comprising:

selectively autonomously operating the untethered object in response to identifying the at least one downhole feature.

6. The method of claim 5, wherein selectively autonomously operating the untethered object comprises selectively radially expanding the untethered object.

7. An apparatus usable with a well, comprising:

a string comprising a passageway; and an untethered object adapted to be deployed in the passageway, such that the untethered object travels in the passageway, the object comprising:

a magnetic field generator;

antennae spatially separated to provide a plurality of signals generated in response to a magnetic field generated by the magnetic field generator;

an expandable element; and a controller to:

cross-correlate the signals;

use the cross-correlation of the signals to identify at least one downhole feature of the string; and selectively radially expand the element based at least in part on the at least one identified downhole feature, wherein the controller is adapted to:

determine a speed of the object based at least in part on the result of a cross-correlation;

cross-correlate the signals for different candidate time shifts;

identify a maximum correlation for the candidate time shifts; and base the determination of the speed based at least in part on the identified maximum correlation.

8. The apparatus of claim 7, wherein the untethered object comprises a balanced coil sensor comprising the antennae.

9. The apparatus of claim 7, wherein the controller is adapted to identify the at least one downhole feature based at least in part on a determined speed of the object and known distances between features of the string.

10. A method comprising:

deploying an untethered object through a passageway of a tubular member;

acquiring a plurality of measurements representing an environment of the tubular member as the object is being communicated through the passageway;

cross-correlating the plurality of measurements; and using results of the cross-correlating to identify at least one feature of the tubular member, wherein using the results of the cross-correlating comprises:

identifying a time shift between at least two measurements of the plurality of measurements; and using the identified time shift to determine a speed of the untethered object, and wherein using the result of the cross-correlating to identify the time shift comprises identifying the time shift based at least in part on a maximum of the cross-correlating evaluated at different candidate time shifts.

* * * * *